US010311989B2

(12) United States Patent
Campbell et al.

(10) Patent No.: US 10,311,989 B2
(45) Date of Patent: Jun. 4, 2019

(54) SYSTEM FOR STORAGE CONTAINER WITH REMOVABLE SHIELD PANELS

(71) Applicant: Kurion, Inc., Irvine, CA (US)

(72) Inventors: Brett Campbell, Richland, WA (US); David Dalton, Richland, WA (US); Brett Lilly, Richland, WA (US)

(73) Assignee: KURION, INC., Irvine, CA (US)

( * ) Notice: Subject to any disclaimer, the term of this patent is extended or adjusted under 35 U.S.C. 154(b) by 66 days.

(21) Appl. No.: 15/603,222

(22) Filed: May 23, 2017

(65) Prior Publication Data

US 2017/0345522 A1 Nov. 30, 2017

Related U.S. Application Data

(60) Provisional application No. 62/342,028, filed on May 26, 2016.

(51) Int. Cl.
*G21F 5/06* (2006.01)
*G21F 5/005* (2006.01)

(52) U.S. Cl.
CPC ..... *G21F 5/06* (2013.01); *G21F 5/005* (2013.01)

(58) Field of Classification Search
CPC . G21F 5/00; G21F 5/005; G21F 5/008; G21F 5/012; G21F 5/06; G21F 5/10; G21F 5/12
USPC ..... 250/505.1, 506.1, 515.1
See application file for complete search history.

(56) References Cited

U.S. PATENT DOCUMENTS 5,493,832 A * 2/1996 Abrams ..... B09B 1/00 52/264
6,114,710 A * 9/2000 Contrepois ..... G21F 5/12 250/506.1
6,283,908 B1 9/2001 Powell et al.
7,211,038 B2 5/2007 Thompson et al.
7,429,539 B2 9/2008 Thompson et al.
2006/0144838 A1* 7/2006 Winn ..... B65D 19/06 220/7
2010/0294960 A1 11/2010 Frank
2015/0368136 A1 12/2015 Raymont et al.
(Continued)

FOREIGN PATENT DOCUMENTS

WO 2013/036970 A1 3/2013
WO 2016/007200 A1 1/2016

OTHER PUBLICATIONS

International Search Report and Written Opinion of International Application No. PCT/US17/34075, dated Sep. 22, 2017; 1-16 pages.

*Primary Examiner* — Jason L McCormack
(74) *Attorney, Agent, or Firm* — Michael Best & Friedrich LLP

(57) ABSTRACT

Disclosed herein are systems and methods for a modular reconfigurable shielding system for one or more storage containers in temporary or long term storage. The system comprises shield panels which may be used to shield external faces of containers in a storage configuration to reduce the overall amount of shielding required in a storage facility. Reducing the amount of shielding reduces the storage footprint of each container thus increasing storage capacity and efficiency of the storage facility. The modularity of the shield panels allows storage containers to be easily added and removed from the storage configuration. Additionally, modular shielding allows the amount and type of shielding to be easily reconfigured for differing requirements and storage contents.

15 Claims, 36 Drawing Sheets

(56) References Cited

U.S. PATENT DOCUMENTS

| | | | | |
|---|---|---|---|---|
| 2016/0012926 | A1* | 1/2016 | Lehnert ..... | G21F 5/012<br>250/506.1 |
| 2016/0225475 | A1 | 8/2016 | Campbell et al. | |

* cited by examiner

SYSTEM FOR STORAGE CONTAINER WITH REMOVABLE SHIELD PANELS

RELATED FILINGS

The following application claims priority to U.S. Provisional Application Ser. No. 62/342,028, filed May 26, 2016 and is incorporated by reference in its entirety.

COPYRIGHT NOTICE

Contained herein is material that is subject to copyright protection. The copyright owner has no objection to the facsimile reproduction by anyone of the patent document or the patent disclosure, as it appears in the United States Patent and Trademark Office patent file or records, but otherwise reserves all rights to the copyright whatsoever. The following notice applies to the software, screenshots and data as described below and in the drawings hereto and All Rights Reserved.

TECHNICAL FIELD

This disclosure relates generally to modular shielding for storage containers, particularly for storage containers comprising substances that either emit unwanted elements, compounds, or materials to the environment, or require protection from the environment.

BACKGROUND

Certain elements, compounds, or materials radiate unwanted or harmful components when stored. One example of this type of material is nuclear waste. Nuclear waste currently in storage comes from three principal sources: spent fuel from commercial or research reactors, liquid waste from the reprocessing of spent fuel, and waste from the nuclear weapons and propulsions industry. Most of the storage concerns relate to so-called 'intermediate and high level' nuclear waste components, which are highly radioactive, often requiring cooling and containment because their decay gives off heat and radiation, and have an extremely long half-life.

Long-term storage of radioactive waste is aided by the stabilization of the waste into a form which will neither react nor degrade for extended periods of time. Currently, vitrification is an accepted practice to achieve this stabilization. The vitrification process requires nuclear waste to be mixed with glass forming media (soil or zeolite, as an example), and heated to the point that the mixture melts. Once cooled, the result is that the nuclear waste is effectively entrained in glass, with reduced chances of leakage and exposure to the environment. Some vitrification methods allow the vitrification process to occur in the actual storage container, thereby minimizing waste handling and reducing contamination possibilities from processing. This type of vitrification is known as in-container vitrification, or ICV™. The containers used for this process are called ICV™ Containers.

Once processed through vitrification, the ICV™ containers are stored, either temporarily or long term. Shielding is used to mitigate potential harmful energy from the radioactive decay of certain elements. Within current shielding for ICV™ storage systems there is little room for reconfiguration and adjustability of the shielding. Additionally, with current systems more shielding is being used than is necessary which is not economical both from materials and storage capacity standpoints. The converse can be true, i.e. some stored compounds or materials need shielding from the environment around them. What is needed is an adjustable, compact, modular shielding system for short or long-term storage containers requiring shielding to prevent either the escape of the contents, particles, or rays, or prevent the ingress of particles or rays to the container.

So as to reduce the complexity and length of the Detailed Specification, Applicant(s) herein expressly incorporate(s) by reference all of the following materials identified in each paragraph below. The incorporated materials are not necessarily "prior art" and Applicant(s) expressly reserve(s) the right to swear behind any of the incorporated materials.

System for Vitrification Container with Removable Shield Panels, Ser. No. 62/342,028, filed May 26, 2016, which is herein incorporated by reference in its entirety, and to which this application claims priority.

System and Method for a Robotic Manipulator Arm, Ser. No. 15/591,978 filed May 10, 2017, with a priority date of May 16, 2016, which is hereby incorporated by reference in its entirety.

Mobile Processing System, Ser. No. 14/748,535, filed Jun. 24, 2015, with a priority date of Jun. 24, 2014, which is herein incorporated by reference in its entirety.

Ion Specific Media Removal from Vessel for Vitrification, Ser. No. 15/012,101 filed Feb. 1, 2016, with a priority date of Feb. 1, 2015, which is hereby incorporated by reference in its entirety.

System and Method for an Electrode Seal Assembly, Ser. No. 15/388,299 filed Dec. 22, 2016, with a priority date of Dec. 29, 2015, which is herein incorporated by reference in its entirety.

Methods for Melting of Materials to be Treated, Pat. No. 7,211,038 filed Mar. 25, 2001, with a priority date of Sep. 25, 2001, which is herein incorporated by reference in its entirety.

Methods for Melting of Materials to be Treated, Pat. No. 7,429,239 filed Apr. 27, 2007, with a priority date of Sep. 25, 2001, which is herein incorporated by reference in its entirety.

Vitrification of Waste with Continuous Filling and Sequential Melting, U.S. Pat. No. 6,283,908 filed May 4, 2000, with a priority date of May 4, 2000, which is herein incorporated by reference in its entirety.

Applicant(s) believe(s) that the material incorporated above is "non-essential" in accordance with 37 CFR 1.57, because it is referred to for purposes of indicating the background or illustrating the state of the art. However, if the Examiner believes that any of the above-incorporated material constitutes "essential material" within the meaning of 37 CFR 1.57(c)(1)-(3), applicant(s) will amend the specification to expressly recite the essential material that is incorporated by reference as allowed by the applicable rules.

Aspects and applications presented here are described below in the drawings and detailed description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112, ¶6. Thus, the use of the words "function," "means" or "step" in the Detailed Description or Description of the Drawings or claims is not intended to somehow indicate a desire to invoke the special provisions of 35 U.S.C. § 112, ¶6, to define the systems, methods, processes, and/or apparatuses disclosed herein. To the contrary, if the provisions of 35 U.S.C. § 112, ¶6 are sought to be invoked to define the embodiments, the claims will specifically and expressly state the exact phrases "means for" or "step for, and will also recite the word "function" (i.e., will state "means for performing the function of . . . "), without also reciting in such phrases any structure, material or act in support of the function. Thus, even when the claims recite a "means for performing the function of . . . " or "step for performing the function of . . . ", if the claims also recite any structure, material or acts in support of that means or step, or that perform the recited function, then it is the clear intention of the inventors not to invoke the provisions of 35 U.S.C. § 112, ¶6. Moreover, even if the provisions of 35 U.S.C. § 112, ¶6 are invoked to define the claimed embodiments, it is intended that the embodiments not be limited only to the specific structure, material or acts that are described in the preferred embodiments, but in addition, include any and all structures, materials or acts that perform the claimed function as described in alternative embodiments or forms, or that are well known present or later-developed, equivalent structures, material or acts for performing the claimed function.

BRIEF DESCRIPTION OF THE DRAWINGS

A more complete understanding of the systems, methods, processes, and/or apparatuses disclosed herein may be derived by referring to the detailed description when considered in connection with the following illustrative figures. In the figures, like-reference numbers refer to like-elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details, process durations, and/or specific formula values are set forth in order to provide a thorough understanding of the various aspects of exemplary embodiments. However, it will be understood by those skilled in the relevant arts, that the apparatus, systems, and methods herein may be practiced without these specific details, process durations, and/or specific formula values. It is to be understood that other embodiments may be utilized and structural and functional changes may be made without departing from the scope of the apparatus, systems, and methods herein. In other instances, known structures and devices are shown or discussed more generally in order to avoid obscuring the exemplary embodiments. In many cases, a description of the operation is sufficient to enable one to implement the various forms, particularly when the operation is to be implemented in software. It should be noted that there are many different and alternative configurations, devices, and technologies to which the disclosed embodiments may be applied. The full scope of the embodiments is not limited to the examples that are described below.

In the following examples of the illustrated embodiments, references are made to the accompanying drawings which form a part hereof, and in which is shown by way of illustration various embodiments in which the systems, methods, processes, and/or apparatuses disclosed herein may be practiced. It is to be understood that other embodiments may be utilized and structural and functional changes may be made without departing from the scope.

A removable shield panel (RSP) system is described herein for providing modular, reusable shielding to storage containers. The system provides a flexible approach to allow expanding storage requirements while minimizing shielding needs. The RSP system is capable of shielding any number and configuration of containers while reducing the amount of shielding materials, reducing storage footprint, and allowing for simple reconfiguration.

Figure 1:
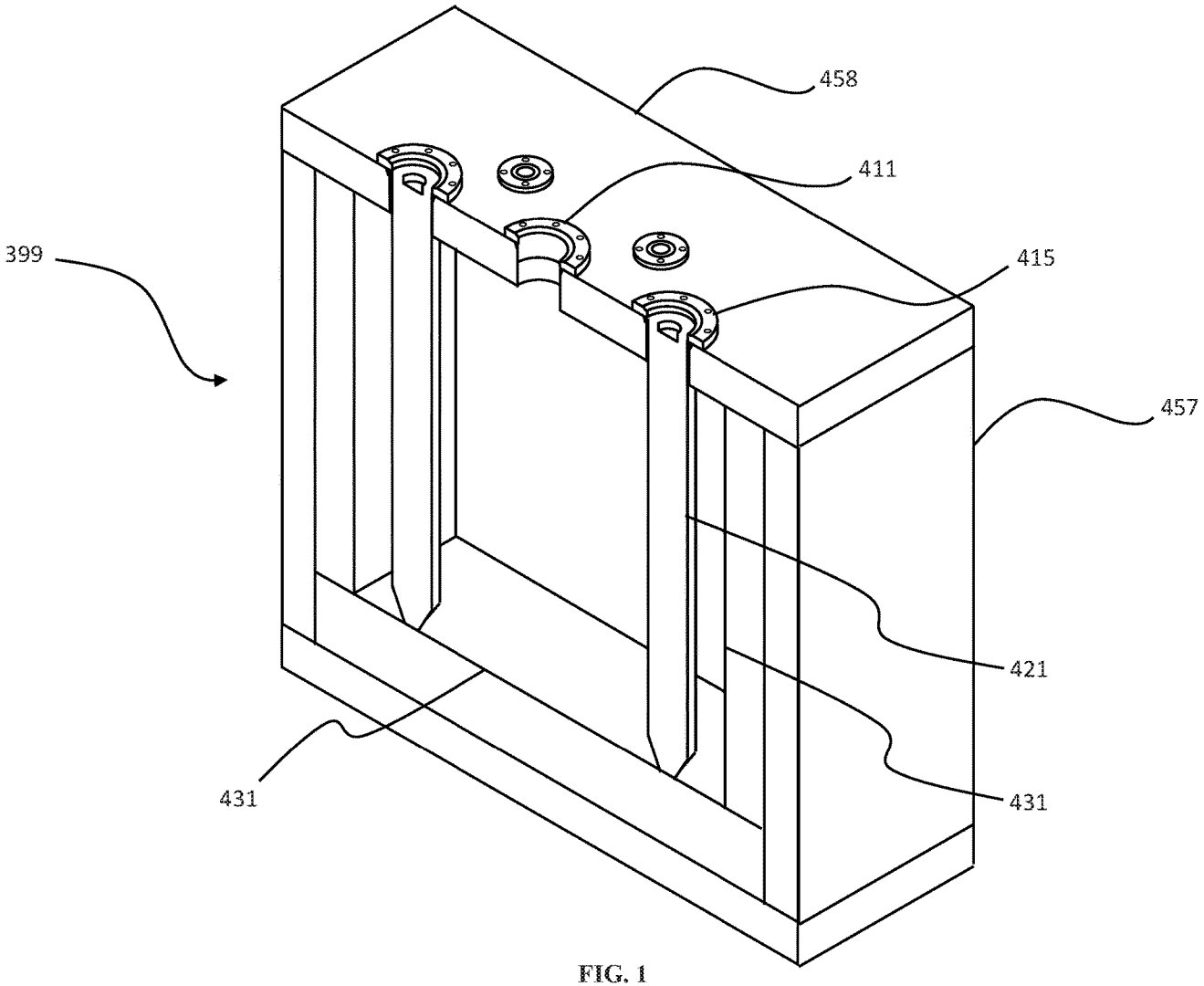
FIG. 1 depicts a cross-section of an embodiment of an In-Container Vitrification (ICV™) container.

In some embodiments, the RSP system may be applied to the nuclear waste storage containers, including, for instance, In-Container Vitrification™ (ICV™) containers. FIG. 1 depicts a cross-section of an embodiment of an ICV™ container 399. Vitrification is the process by which a vitrified product with embedded contaminants is formed. Vitrification is the gold standard for long-term waste disposal due to the very low leachability of contamination out of the vitrified product. ICV™ is a system wherein the vitrification occurs in a one-time use or a reusable container. In some embodiments, the container is used only once for vitrification and serves as the final storage container. In some embodiments, a container may serve as the treatment and storage container for a vitrified waste form resulting from the treatment of solid wastes (ion-specific media (ISM), sludge, liquid processing waste, soils, ash, decontamination, and decommissioning wastes, etc.).

The ICV™ container 399 depicted in FIG. 1 comprises outer shielding 457, refractory lining 431, feed port 411, starter path (not shown), electrodes 421, and lid (built in hood) 458. In some embodiments, the outer shielding 457 is composed of a metal such as steel. The lid 458 may comprise one or more electrode penetration/seal 415 assemblies that keep electrodes 421 in contact with the starter path while providing electrical insulation between the electrodes 421 and the ICV™ container 399. The ICV™ container 399 is described in more detail in Ion Specific Media Removal from Vessel for Vitrification, Ser. No. 15/012,101 filed Feb. 1, 2016, with a priority date of Feb. 1, 2015, which is hereby incorporated by reference in its entirety.

The depicted embodiments show ICV™ containers as example storage containers. It should be clear that the containers are not necessarily ICV™ containers and may take other forms. The same principles and design aspects may be applied to many different styles and configurations of containers. The term "container" as used herein may refer to an ICV™ container or any other container type or style that may utilize the shielding principles and/or designs disclosed herein. While vitrified nuclear waste is disclosed as an example material requiring shielding in storage it should be clear that the same principles may be applied to other waste forms and other materials requiring shielding. For instance, in a temperature controlled facility the shielding may be used as thermal insulation. Electromagnetic shielding may be used for redirecting magnetic flux, and radio frequency shielding may be used to block radio waves. Other embodiments are contemplated.

Figure 2:
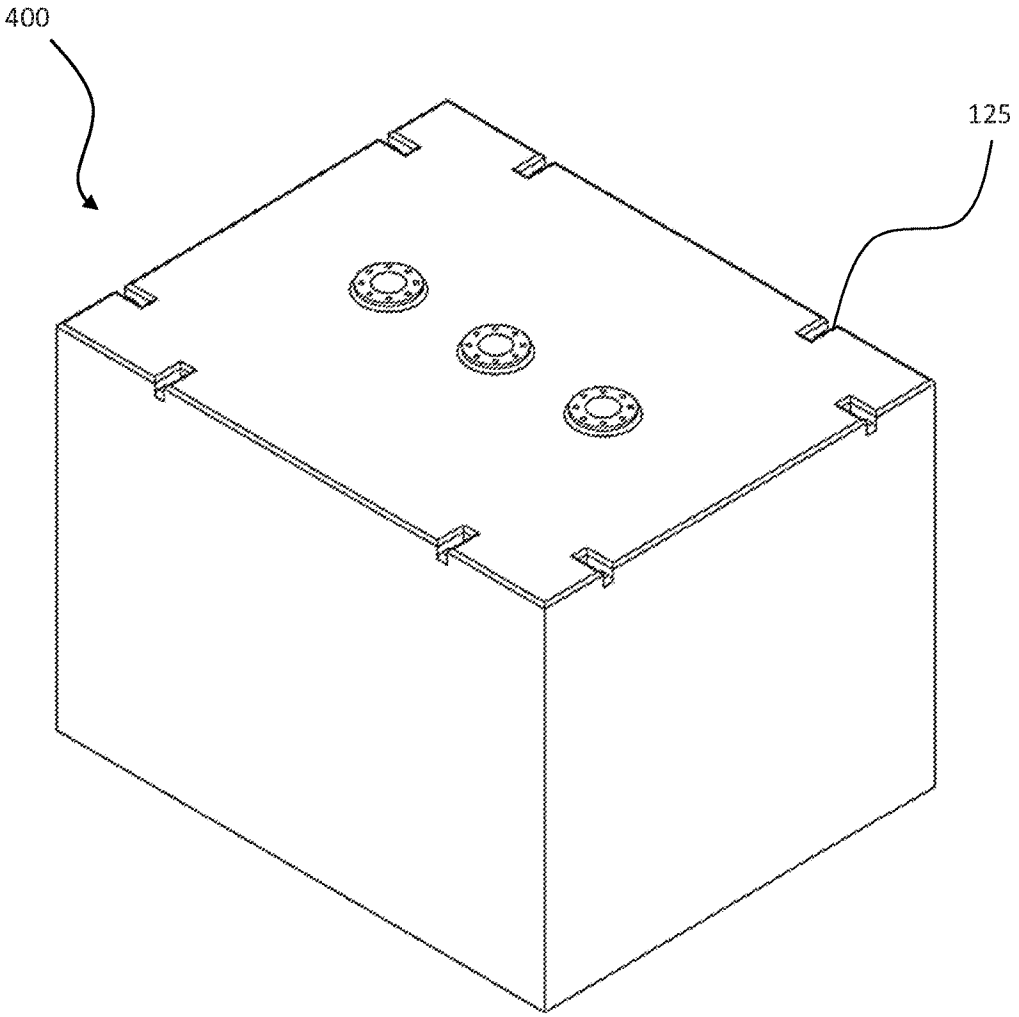
FIG. 2 depicts an isometric view of an ICV™ container embodiment.

FIG. 2 depicts an isometric view of an embodiment of an ICV™ container 400. The depicted embodiment is a variation of the ICV™ container 399 depicted in FIG. 1, modified for the installation of a removable shield panel embodiment. The modifications comprise the addition of one or more shield mounting points 125 to facilitate mounting of shield panels. The shield mounting points 125 may vary in quantity, location, and form between various embodiments. Some embodiments of the shield panels may not require shield mounting points on the ICV™ container 400. In some embodiments, shield panels may be attached to the storage containers using one or more coupling mechanisms including magnetics, tongue and groove, suction cups, and Velcro®, among others.

Figure 3:
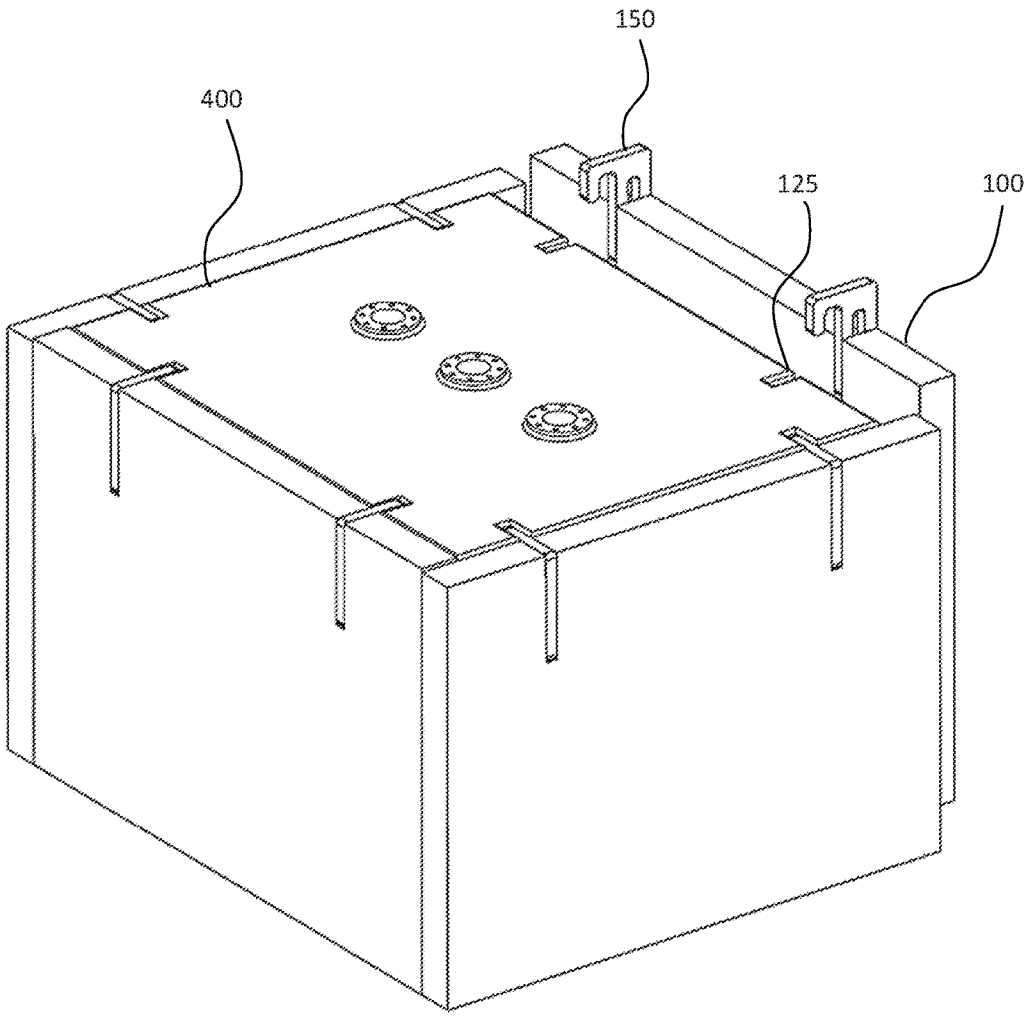
FIG. 3 depicts an isometric view of the modified ICV™ container embodiment of FIG. 2 with mounted removable shield panels.

FIG. 3 depicts the modified ICV™ container 400 embodiment of FIG. 2 with shield mounts 125 and shield panels 100. Each container 400 may comprise one or more shield mounting points 125 on each side. In the depicted embodiment, each container 400 comprises two shield mounting points 125 on each side of the top of the container 400 for a total of eight shield mounting points 125 per container 400. The type, geometry, quantity, and location of the shield mounting points 125 may vary between embodiments. Shield mounts 150 are shaped to engage with the shield mounting points 125 on the container 400. In the depicted embodiment, a single container 400 is shielded on all sides.

Figure 4:
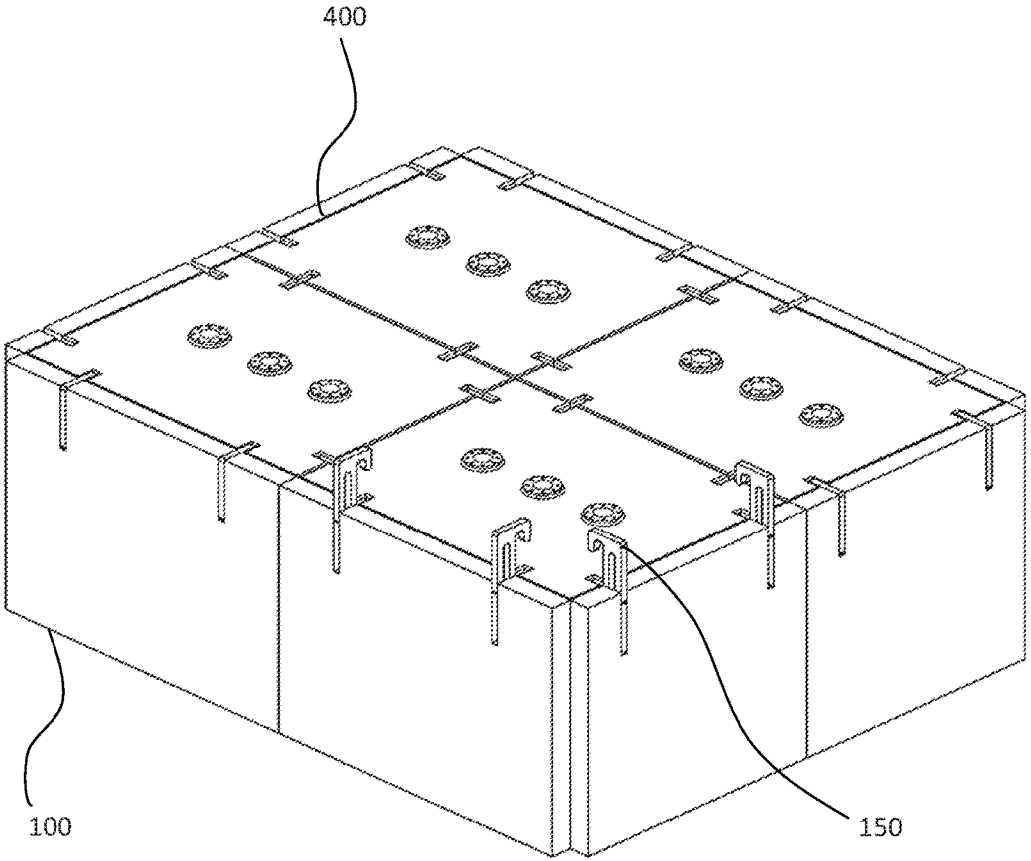
FIG. 4 depicts four modified ICV™ containers with mounted removable shield panels.
Figure 5:
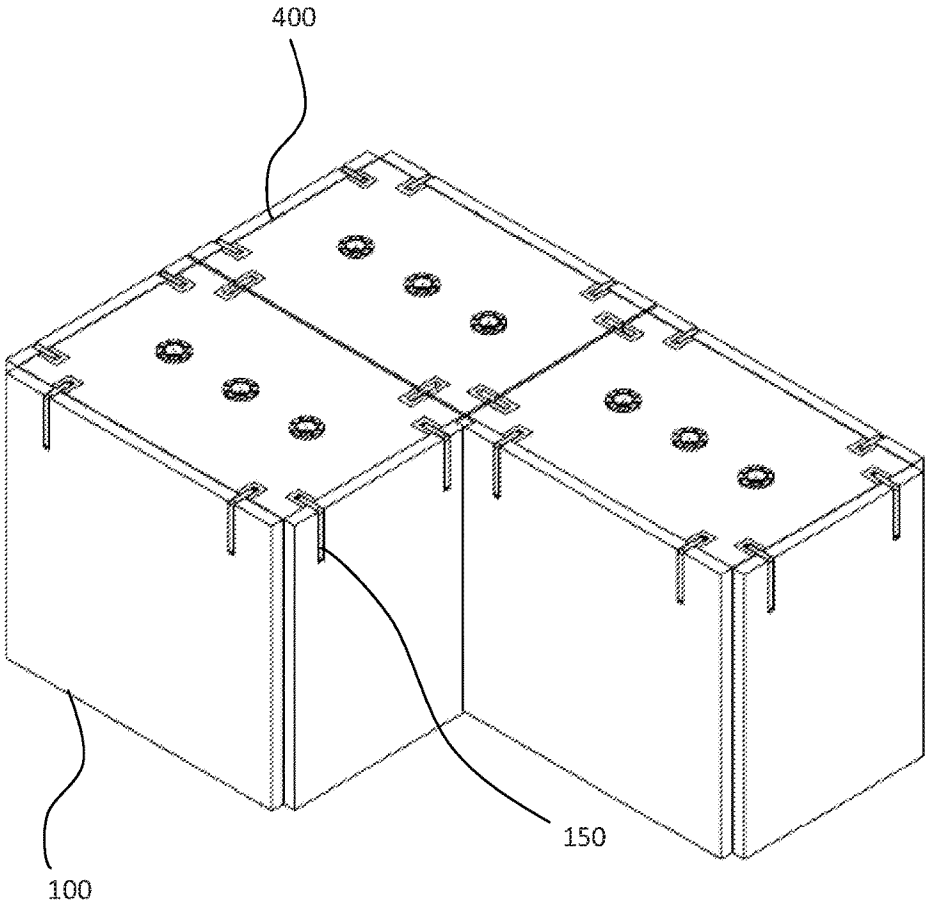
FIG. 5 depicts three modified ICV™ containers with mounted removable shield panels.

When containers 400 are stored they are generally stacked and layered. The internal containers 400 in a storage configuration often do not require individual shielding because shielding is at least partially provided by adjacent containers 400. When the containers 400 are stored together generally only the sides of the outermost containers 400 that are exposed to the storage environment require shielding. The RSP system may be used to shield external sides of stored containers thus reducing the amount of shielding required in a storage facility. As the number of containers 400 in a storage facility increases or decreases, the shielding of the outermost containers 400 may be easily adjusted by moving the removable shield panels 100 and preinstalling them on the exposed container 400 surfaces. FIGS. 4 and 5 depict single layer container 400 configurations where the shield panels 100 are mounted on only the outermost (exposed) surfaces of the containers 400 and secured with shield mounts 150. Top shield panels may be used to cover the top of the uppermost layer of containers 400.

Figure 6:
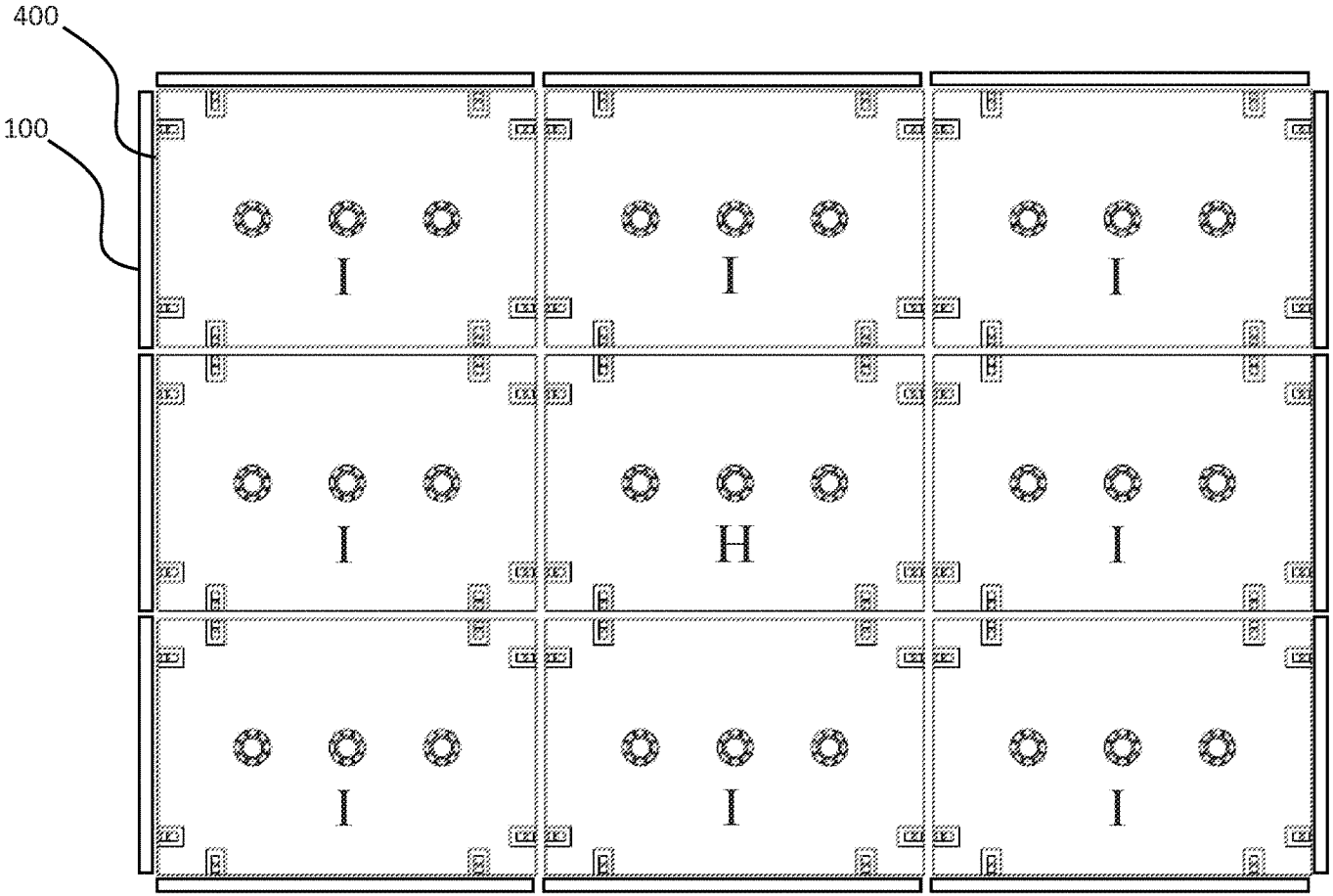
FIG. 6 depicts an example embodiment of containers containing different activity levels of nuclear waste.

FIG. 6 depicts an example embodiment of a layer of ICV™ containers 400 containing vitrified nuclear waste. Nuclear waste is often classified by activity level with the common levels being low, intermediate, and high activity waste. Low activity waste generally requires little or no shielding whereas high activity waste may require a large amount of shielding. In the depicted embodiment, the containers 400 are filled with different classes of nuclear waste. The innermost container 400 is high (H) level and the surrounding containers 400 are intermediate (I) level. This embodiment illustrates how a lower level waste (the intermediate waste) can be used as shielding for higher level waste thus reducing shielding requirements in the storage facility. Reducing the amount of shielding reduces the storage footprint of each container 400 thus increasing capacity and efficiency of a storage facility. Additionally, the RSP system decouples the shielding from the container 400 from a weight standpoint thereby potentially increasing the amount of material that can be stored in each container 400.

Figure 7:
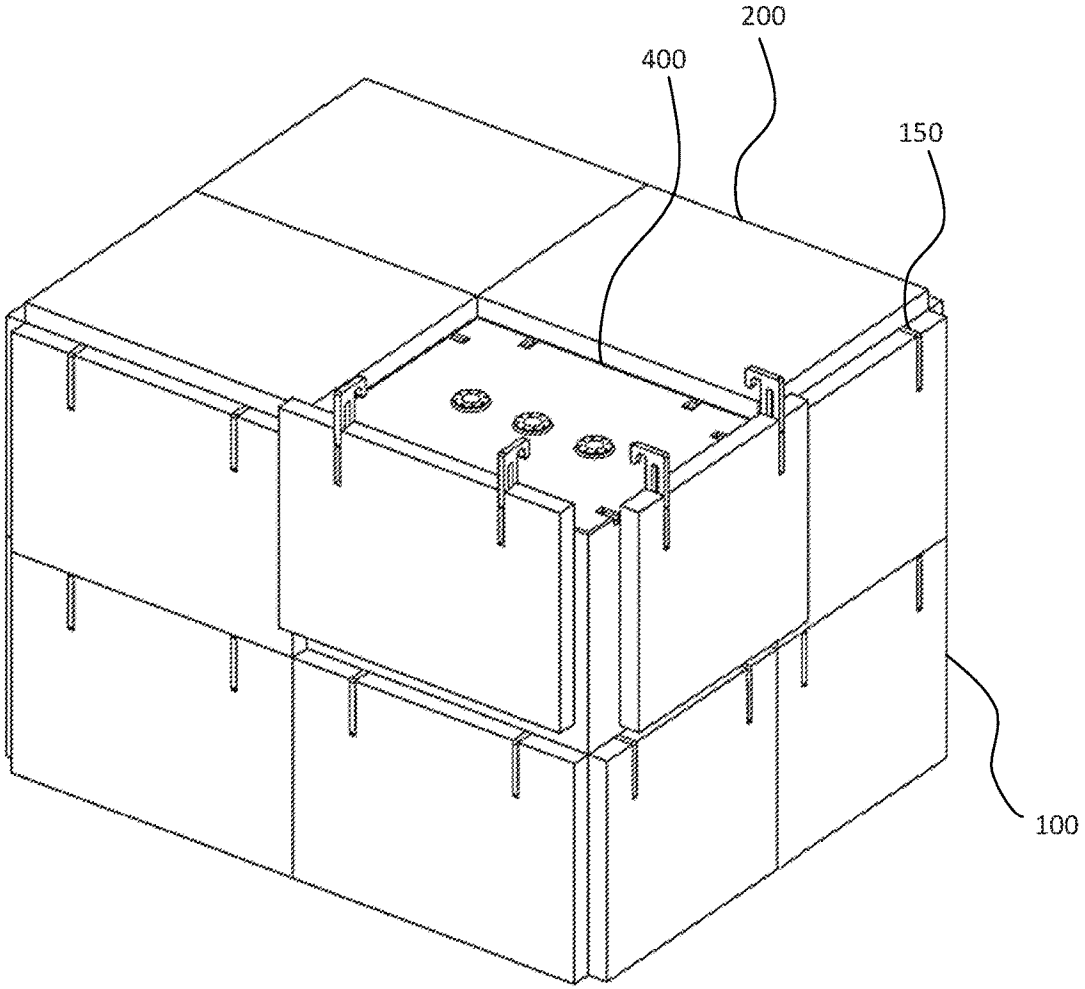
FIG. 7 depicts eight modified ICV™ containers in a stacked configuration with mounted removable shield panels.
Figure 8:
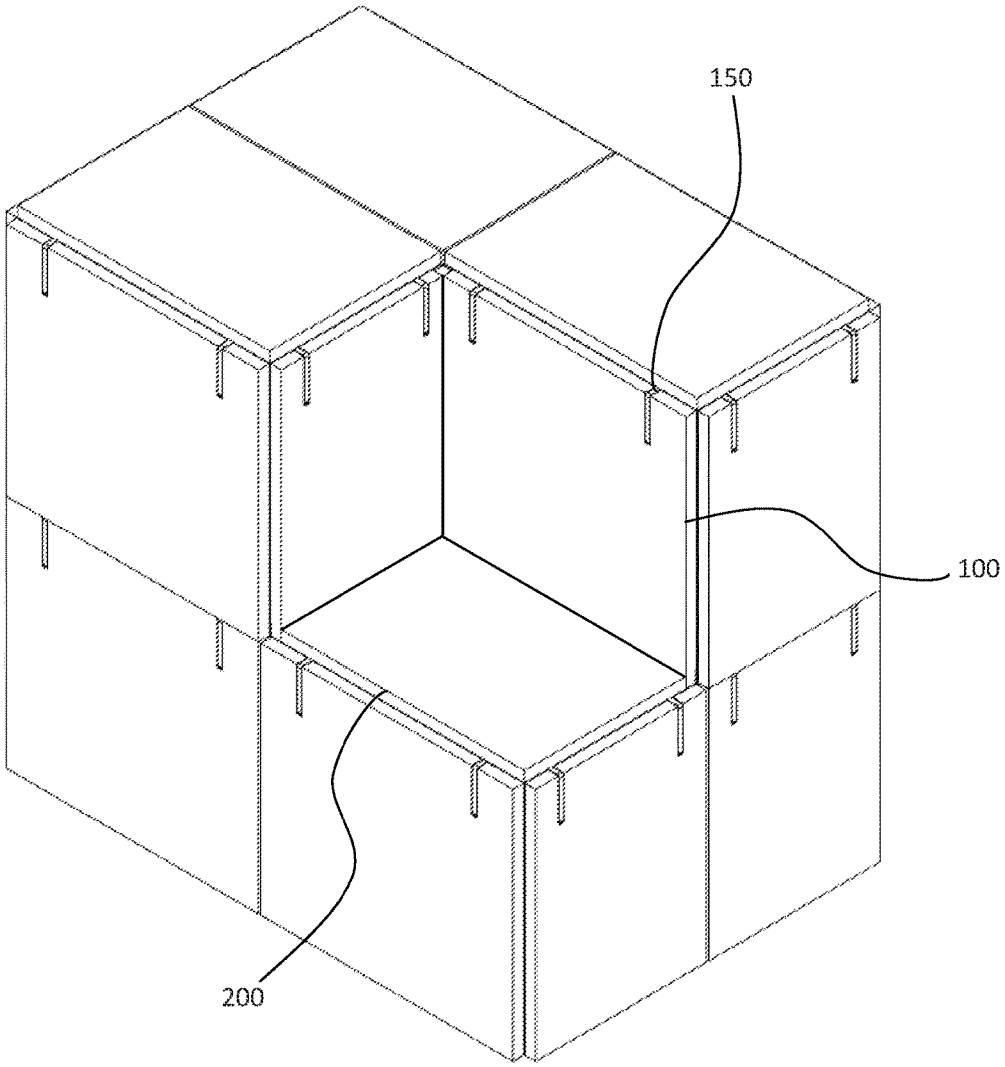
FIG. 8 depicts seven modified ICV™ containers in a stacked configuration with mounted removable shield panels.

In some embodiments, the containers 400 may be stacked in two or more layers to minimize storage footprint and maximize storage capacity. FIGS. 7 and 8 depict ICV™ containers 400 in example stacked configurations with mounted removable shield panels 100 and top shield panels 200, secured with shield mounts 150. While the depicted embodiments comprise two layers it should be clear that the containers may be stored in other configurations included one or more layers.

Figure 9A:
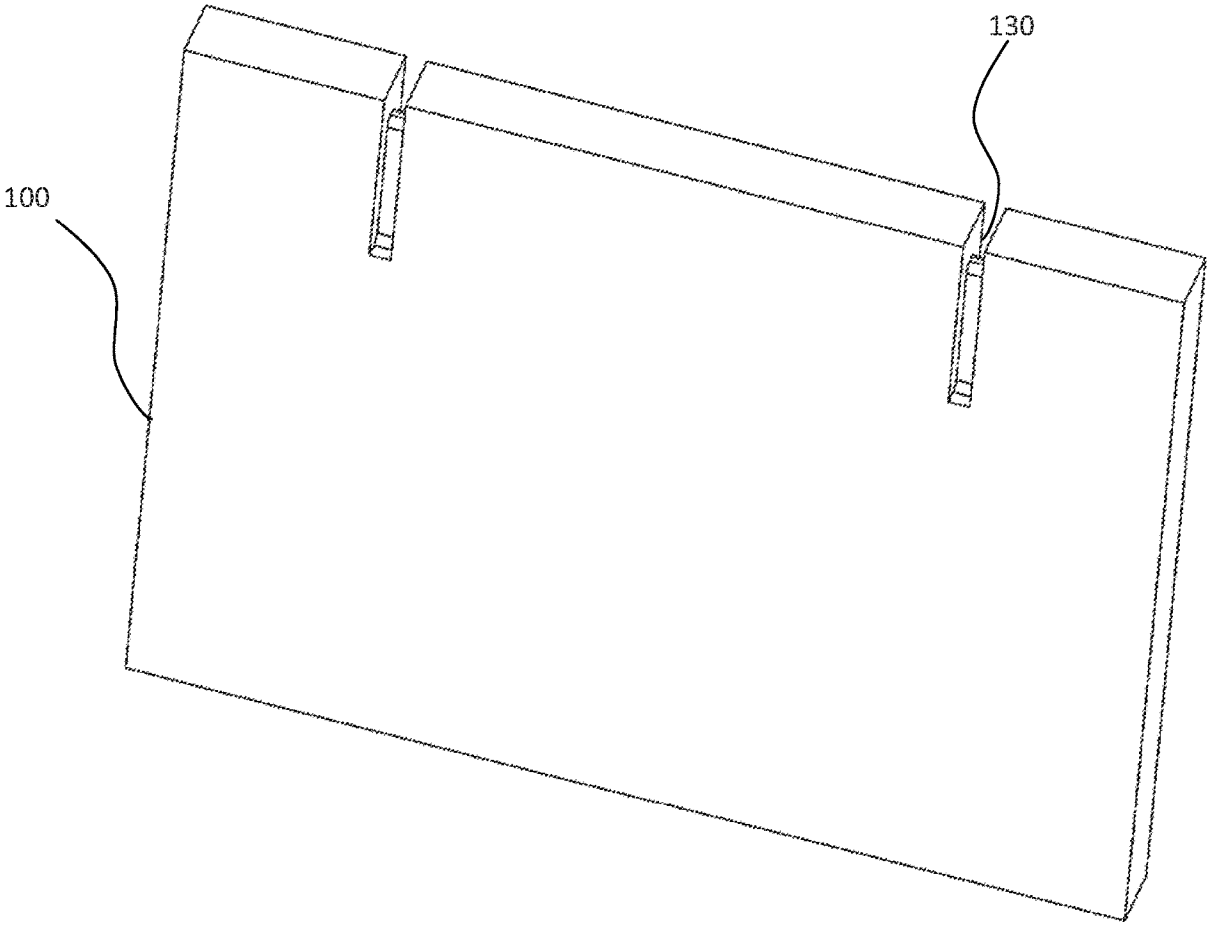
FIG. 9A depicts an embodiment of a removable shield panel.
Figure 9B:
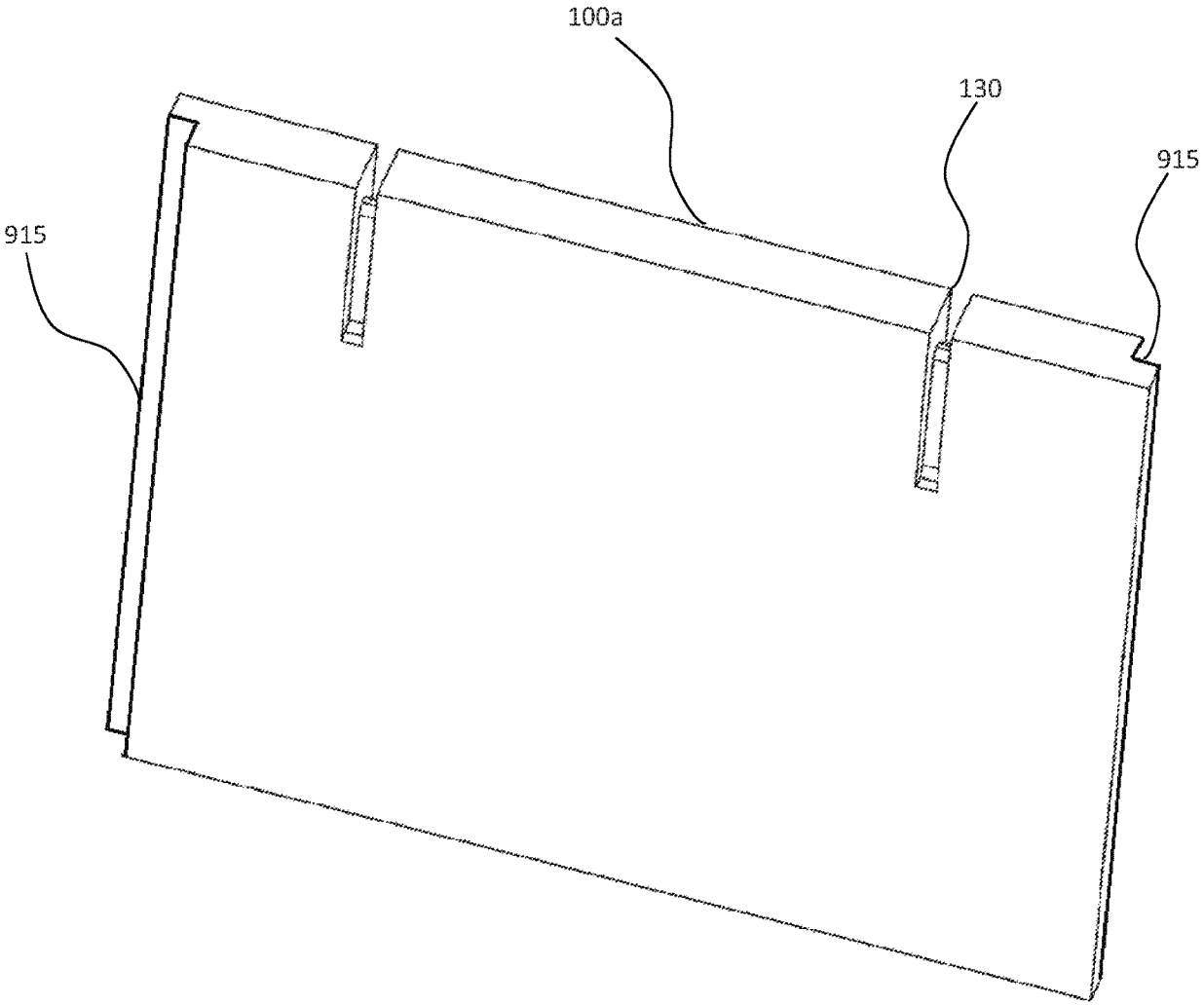
FIG. 9B depicts an embodiment of a removable shield panel having tabbed edges.
Figure 9C:
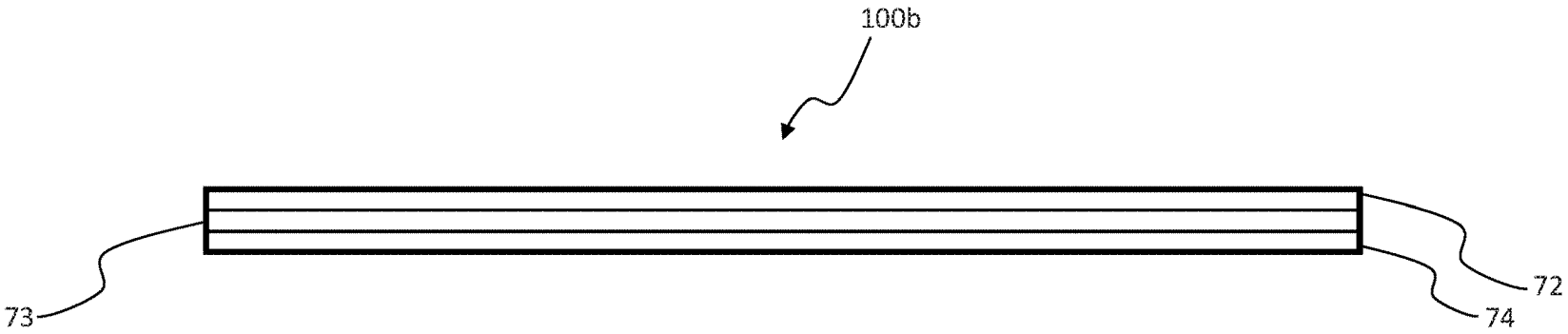
FIG. 9C depicts a top down cross-sectional view of a layered shield panel.

FIG. 9A depicts an embodiment of a generic removable shield panel 100. FIG. 9B depicts an example shield panel 100*a* comprising tabbed edges 915 which may overlap to prevent gaps between shield panels 100*a* when they are used side by side. Removable shield panels 100 may be composed of a wide range of materials which may be dependent upon the shielding's purpose. Shield panels 100 may vary in thickness and/or comprise layers of different materials. FIG. 9C depicts a top down cross-sectional view of an example shield panel 100*c* comprising three layers 72, 73, and 74 of differing materials. Different embodiments may comprise varying numbers and thicknesses of layers of one or more different materials. For example, in nuclear waste storage, shield panels 100 may comprise one or more layers of materials including one or more of concrete, steel, lead, and mullite refractory, among others, to reduce radiation dosage rates. In some embodiments, steel shield panels have a half-value layer of 16 mm for Cs-137/Ba-137m radiation. Other half-value layer configurations are possible.

In temperature-controlled facilities shield panels may comprise thermal insulation material(s). In some embodiments, shield panels may be composed of, or comprise a layer of, a bumper or impact resistant material to protect storage contents from impact. Shield panels may comprise conductive or magnetic materials, such as copper in some embodiments, to shield storage contents from electromagnetic flux. In some embodiments, shield panels may comprise multiple layers of differing materials operable to provide shielding of one or more different types. For example, electronic equipment may utilize shield panels that comprise at least a thermal shield layer and an electromagnetic shield layer.

In some embodiments, one or more shield panels or materials therein may be layered wherein they connect using an interlocking concept similar to LEGOs® such that layers may be added and removed without modification to the shielding mounts. In some embodiments, one or more shield panels or materials therein may be layered wherein they connect using one or more of magnetism, suction, Velcro®, or other removable connection types known in the art.

Figure 10A:
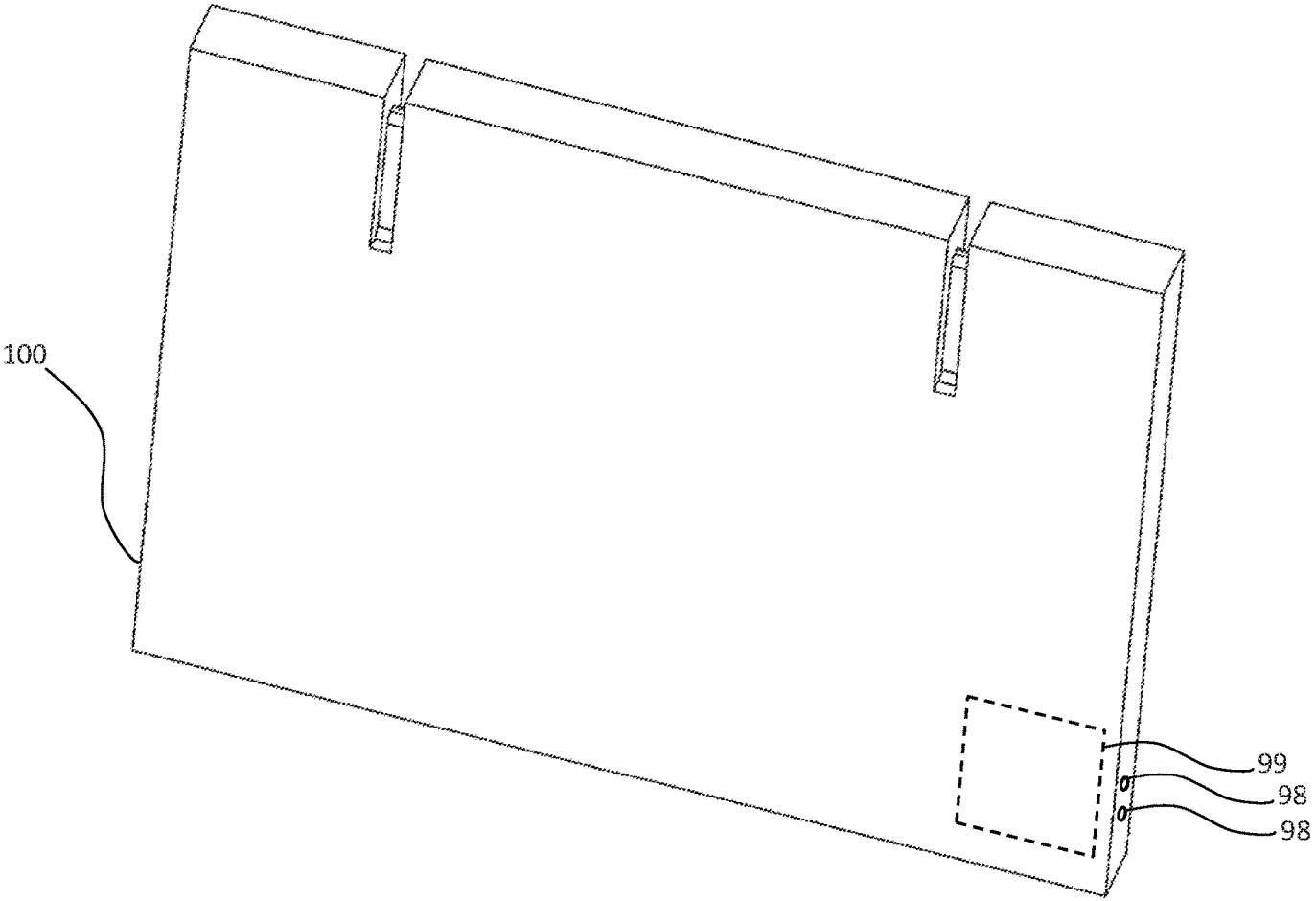
FIG. 10A depicts the removable shield panel embodiment of FIG. 9A further comprising control circuitry.

In some embodiments, such as the embodiment depicted in FIG. 10A, shield panels 100 may comprise circuitry 99 including temperature control mechanisms for providing cooling or heating to storage containers. In such embodiments, shield panels 100 may comprise electric circuit connectors 98 such that the connectors 98 align for simple connection during setup/reconfiguration. In some embodiments, such as for temporary storage and/or transportation, each shield panel may comprise standalone temperature control mechanisms. In some embodiments, shield panels may be hollow or comprise channels in the side facing the containers to reduce weight and/or to allow controlled airflow around the storage containers. In some embodiments, shield panels may comprise one or more sensors. Sensors may serve to alert in the event of leakage, temperatures outside acceptable ranges, vibration, radiation, and other conditions that may be detrimental to the stored materials, the environment, and/or workers.

Figure 10B:
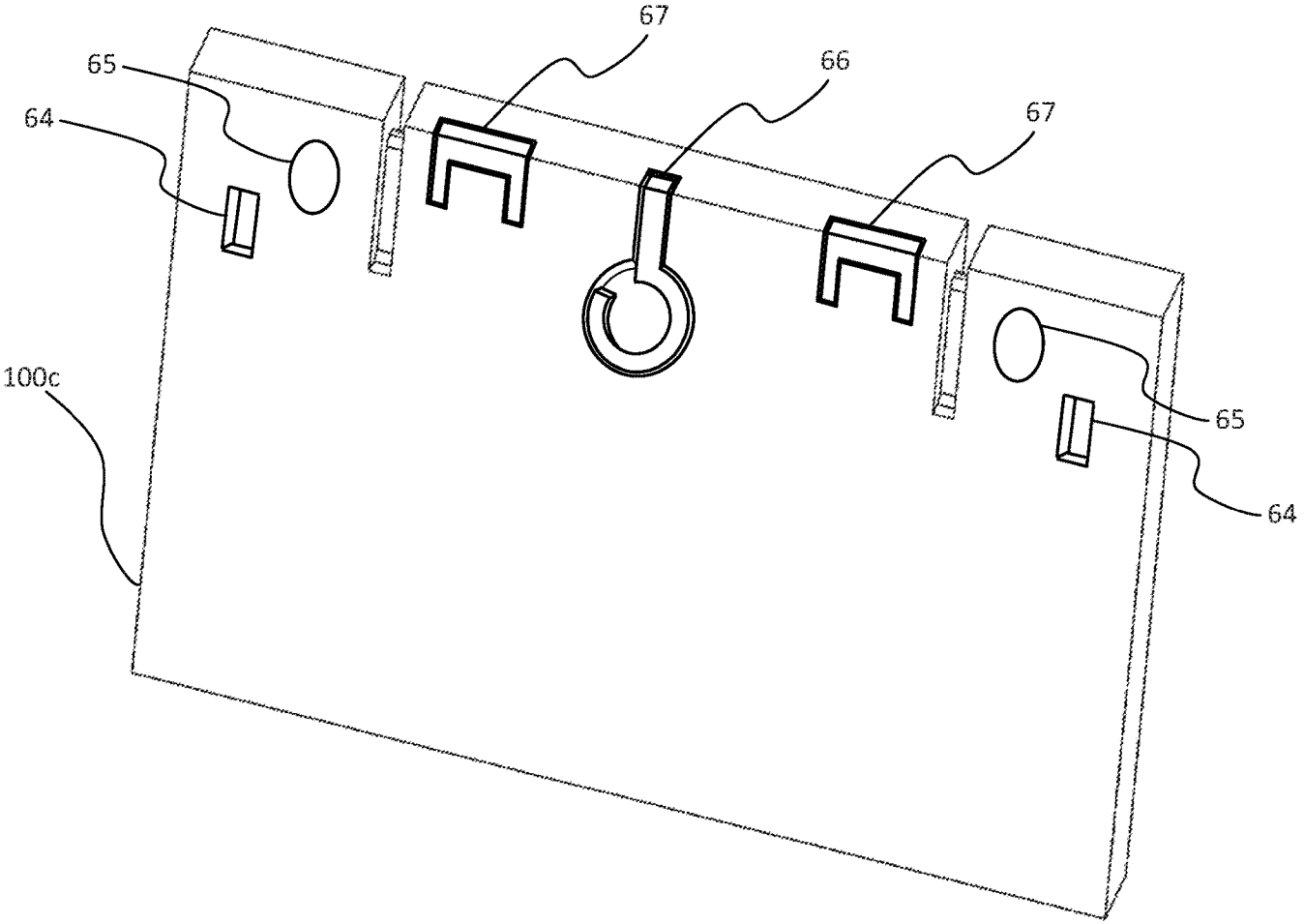
FIG. 10B depicts the removable shield panel embodiment of FIG. 9A further comprising example hooks, handles, and magnetic connectors to facilitate reconfiguration.

In some embodiments, the shield panels may further comprise one or more mechanisms to facilitate placement, lifting, and removal. The mechanisms may take the form of hooks, handles, recesses, and magnetic connectors, among others. The one or more mechanisms may, when not in use, lay flush with, recessed from, or protruding from the surface of the shield panel, in some embodiments. FIG. 10B depicts the removable shield panel embodiment of FIG. 9A further comprising example hooks, handles, and magnetic connectors to facilitate reconfiguration. The depicted placement facilitation mechanisms are shown for example purposes only. The particular combination, types, amount, positioning, geometry, and sizes of the depicted mechanisms may vary between embodiments.

In the embodiment depicted in FIG. 10B, the shield panel 100*c* comprises three example shield placement facilitation mechanisms: recesses 64, magnetic connectors 65, hook 66, and handles 67. The recesses 64 may provide surfaces in the shield panel 100*c* upon which an upward force may be applied for lifting and repositioning the shield panel 100*c*. Magnetic connectors 65 may provide areas or sections of the shield panel 100*c* which are magnetic such that a magnetic force may be applied to lift and transport the shield panel 100*c*. Hook 66 may be hinged such that it may fold upwards when needed to lift the shield panel 100*c* and down against or recessed into the shield panel 100*c* when not in use. Handles 67 may fold outwards or slide upwards from the shield panel 100*c* as needed.

Figure 11:
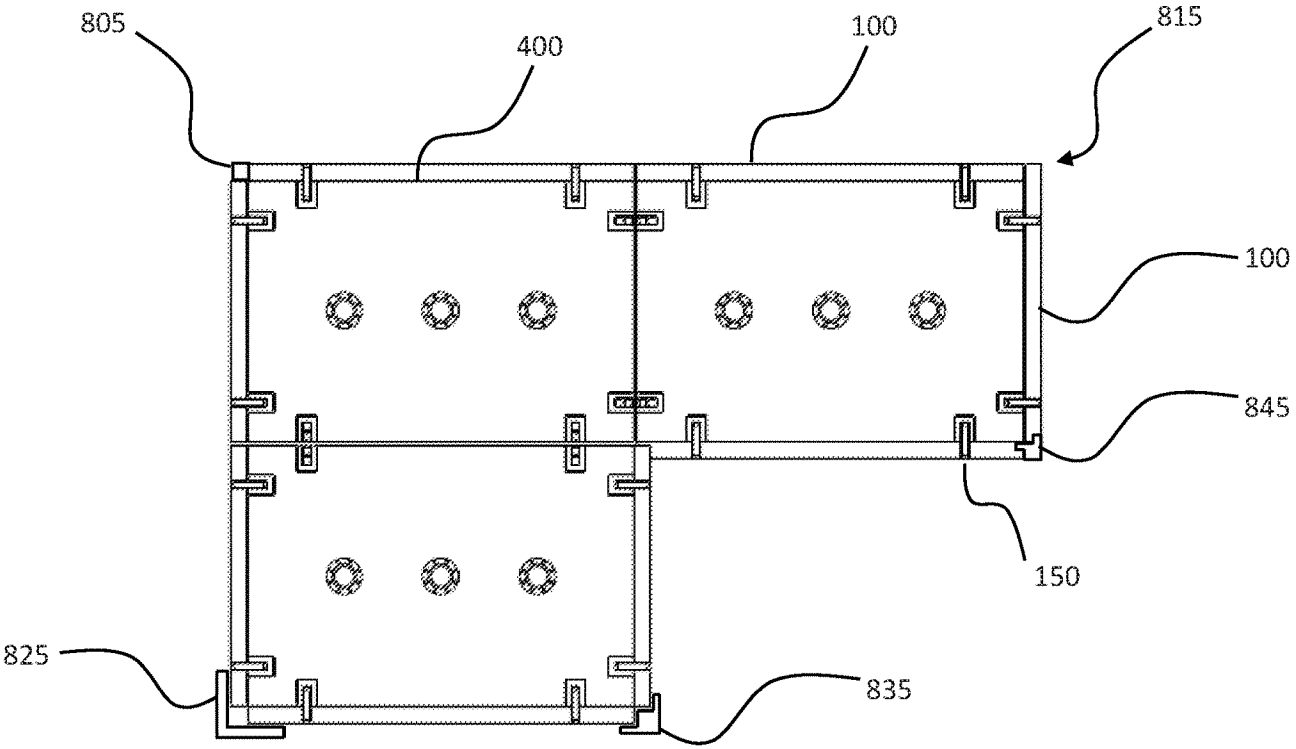
FIG. 11 depicts several example embodiments of corner shielding.

In some embodiments, corner shielding may be provided along the edges to cover any gaps that may exist between side shield panels 100 (FIG. 9A) and between top panels and side shield panels 100 (FIG. 9A). FIG. 11 depicts an embodiment for example corner shielding types. Corner 815 shows overlapping side shield panels 100 secured to container 400 with shield mounts 150. Corner 845 shows corner shielding that may be used for tabbed shield panels (FIG. 9B). Corner 825 is a simple L shaped overlapping corner piece. Corner 805 is a simple square cross-section panel. Corner 835 is a combination of corner 805 and 825. In some embodiments, corner shielding may be attached to the shield panels using one or more coupling mechanisms including magnetics, tongue and groove, dovetail joints, suction cups, and Velcro®, among others.

Figure 12A:
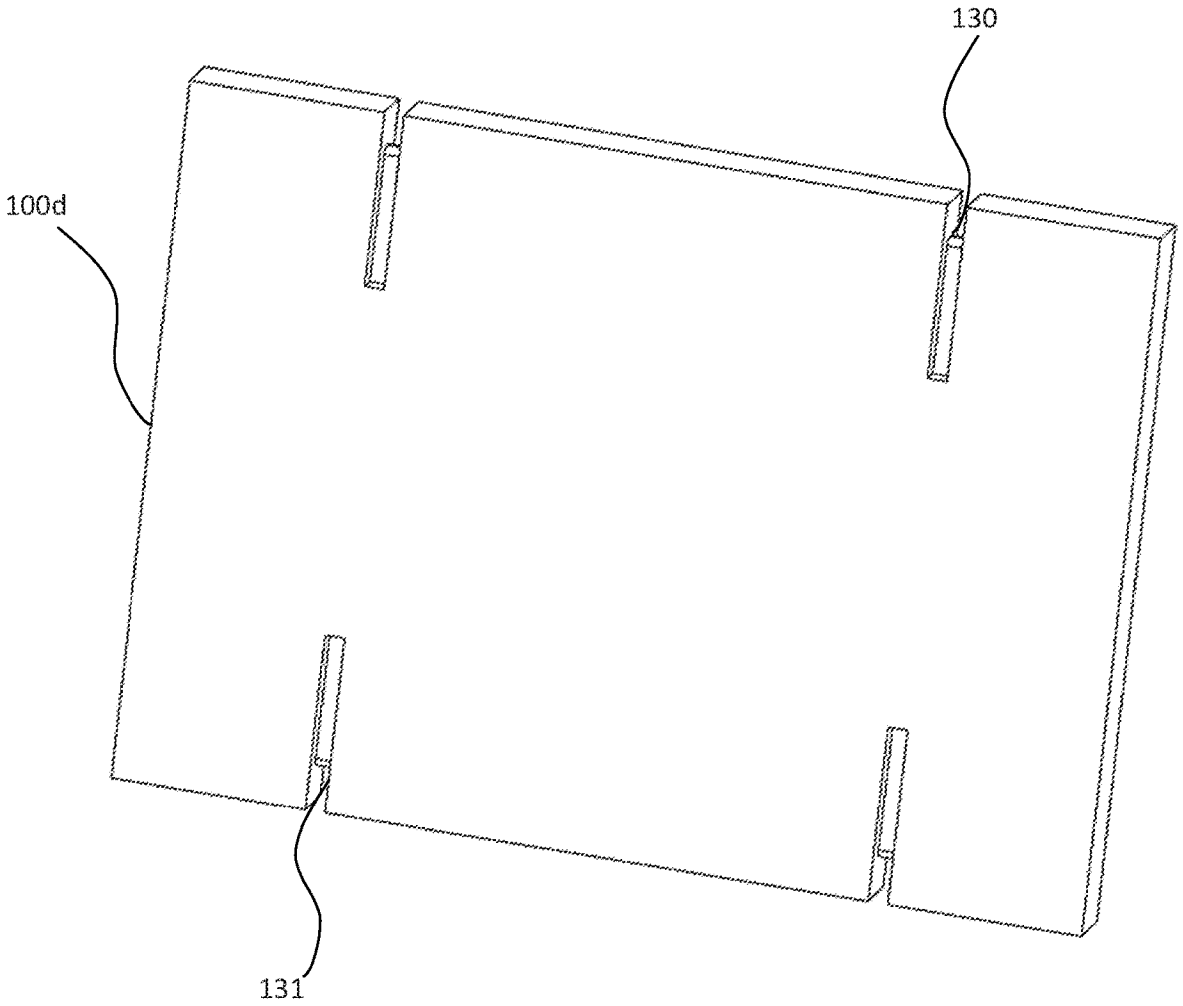
FIG. 12A depicts an embodiment of the side shield that can be secured both at the top and bottom.
Figure 12B:
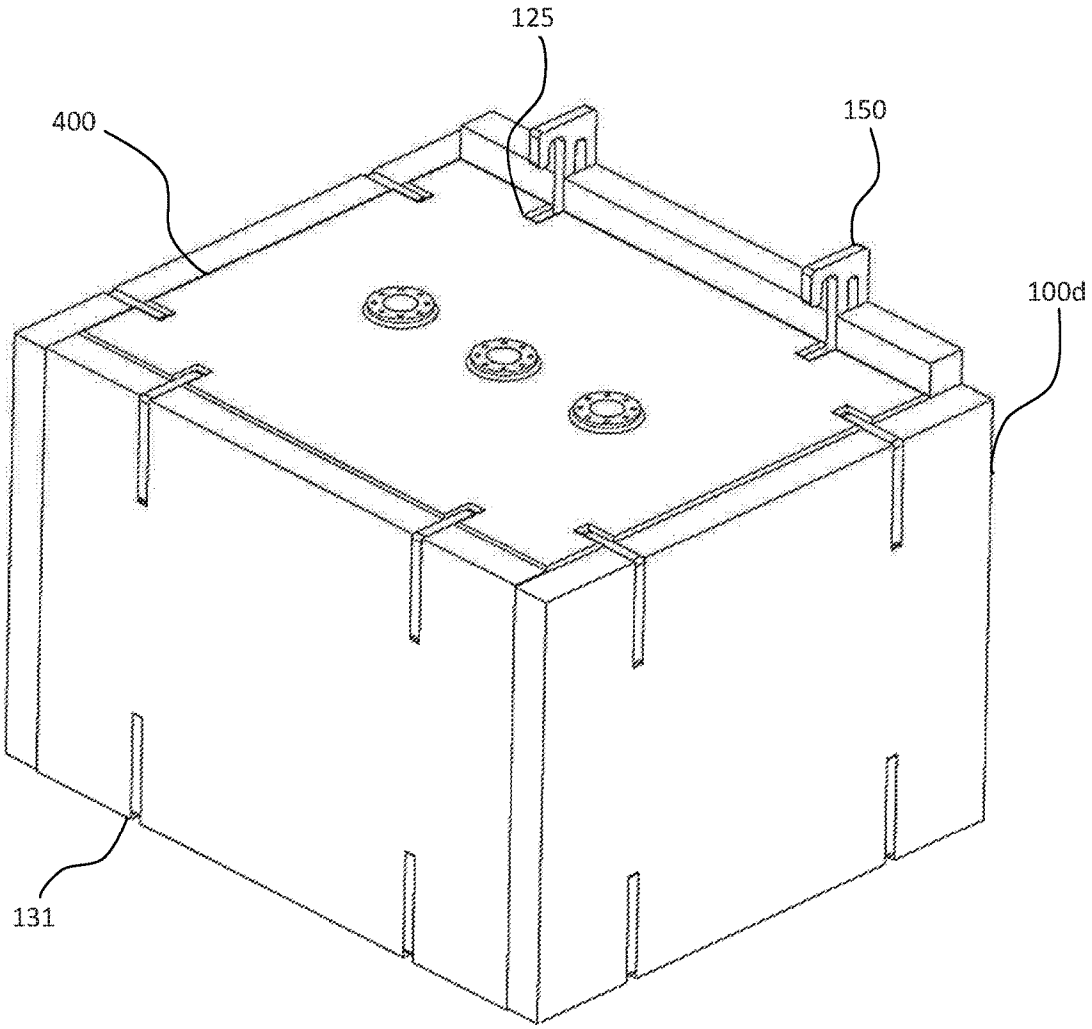
FIG. 12B depicts an isometric view of a container utilizing shields that are secured with shield mounts in both the top and the bottom.

FIG. 12A depicts an alternate embodiment of a side shield 100*d* with mounting points 131 for additional shield mounts 150 (FIG. 12B) on both the top and bottom sides of the shield 100*d* for added stability and easier reconfiguration. In some embodiments, bottom shield mounts and mounting points 131 may be the same or similar geometry as top shield mounts and mounting points 130. FIG. 12B depicts the shield panel 100*d* in use. In some embodiments, bottom shield mounts 131 may mount orthogonally or at an angle from the side rather than from the bottom such that they may be removed without having to lift or move the container. The addition of bottom mounts 131 may require a pull and lift force in order to remove the shield panels 100*d*. Adding an extra force for removal increases stability, thus reducing chances of slippage over time or slippage due to outside forces or impacts such as earthquakes.

Figure 13:
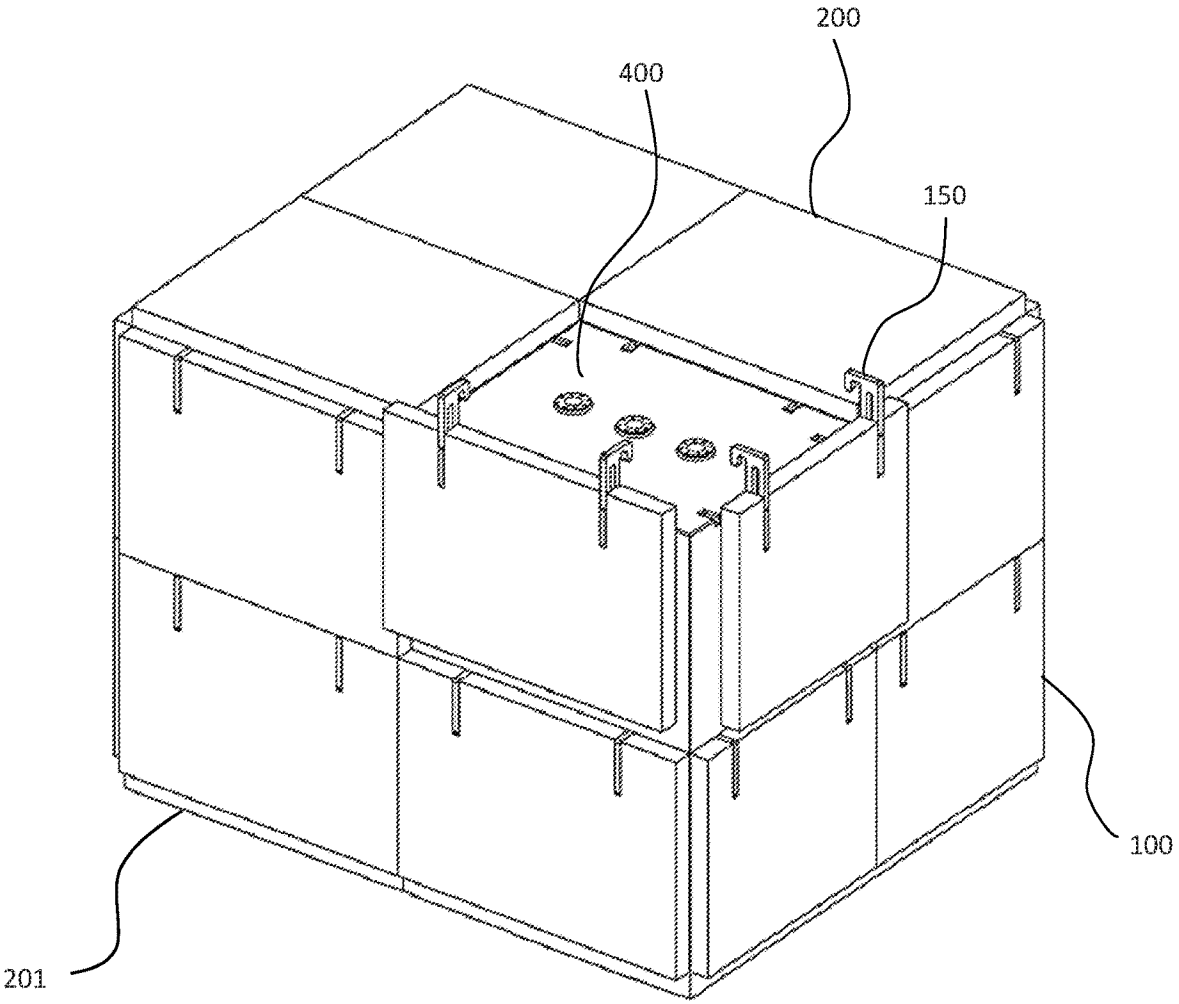
FIG. 13 depicts a stacked configuration of ICV™ containers utilizing bottom shields.

FIG. 13 depicts an embodiment that utilizes bottom shields 201 in similar geometry as the top shields 200. In some embodiments, top shields 200 and bottom shields 201 may be incorporated with the side shields 100 to completely shield one or more containers. In some embodiments, the shield mount may be designed to secure a combination of one or more side shields 100, top shields 200, and bottom shield 201 together forming an enclosure for housing one or more containers. In some embodiments, bottom shielding is not required as the floor of the storage facility may provide adequate shielding. In some embodiments, bottom shielding may be in the form of a continuous pad or section of flooring.

Figure 14:
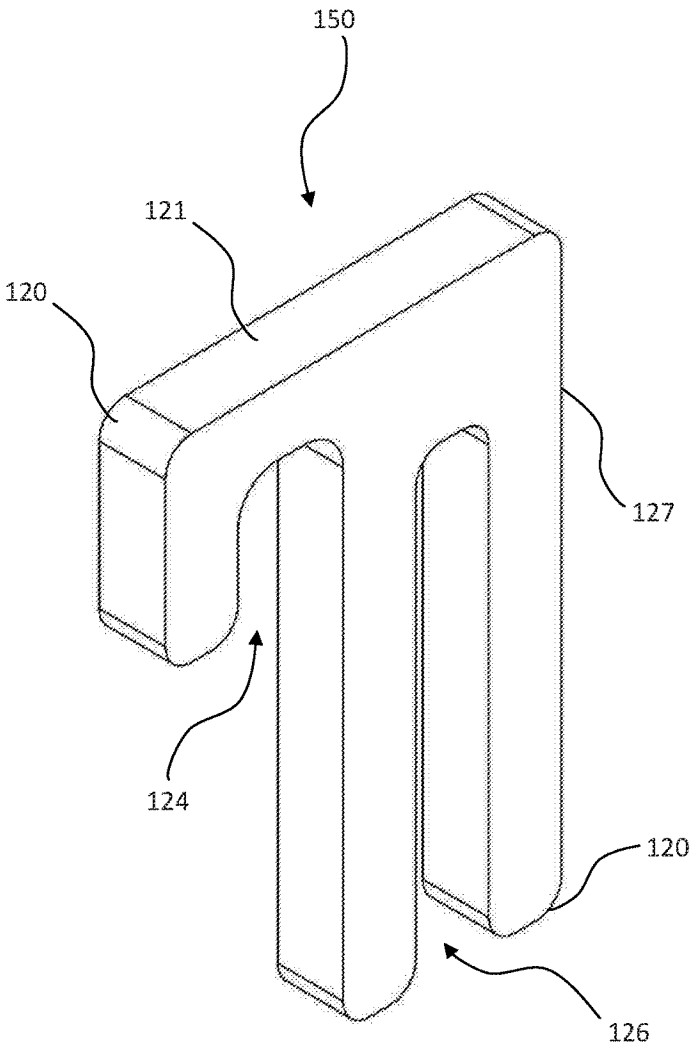
FIG. 14 depicts an embodiment of a simple shield mount.

FIG. 14 depicts an embodiment of a shield mount 150. The depicted shield mount 150 comprises slots 124 and 126 where slot 124 fits over a mount point on the modified ICV™ container and slot 126 fits over a mount point in the shield panel. The slotted mounting mechanism facilitates simple mounting of shield panels and allows the shield panels to be easily lifted upwards for removal. When the shield mount 150 is placed correctly and completely the top surface 121 is flush with the top of the container and the outer surface 127 is flush with the outer surface of the shield panel, in some embodiments. In some embodiments, one or both of surface 121 and surface 127 may be either recessed or protruding. The filleted corners 120 allow for the shield mount 150 to be easily removed by hand or hand tool, if necessary. Typically the shield panels may be removed and reconfigured remotely. In some embodiments, one or more of the shield mounts 150 may be integrated with the shields. In some embodiments, a crane and/or robotic manipulator arm may be used as an apparatus for shield reconfiguration wherein the apparatus may be locally or remotely controlled. Some embodiments may utilize a robotic remote control system for shield reconfiguration. An example of such a robotic control system may be found in co-pending U.S. patent application Ser. No. 15/591,978, entitled System and Method for a Robotic Manipulator Arm, filed May 10, 2017, with a priority date of May 16, 2016, which is hereby incorporated by reference in its entirety elsewhere in this document.

Figure 15A:
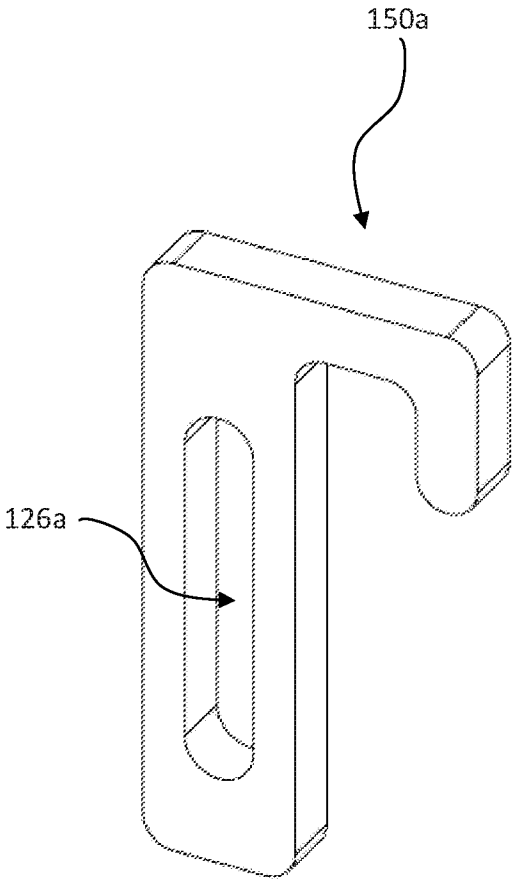
FIG. 15A depicts an isometric view of a variation of the shield mount embodiment of FIG. 14.
Figure 15C:
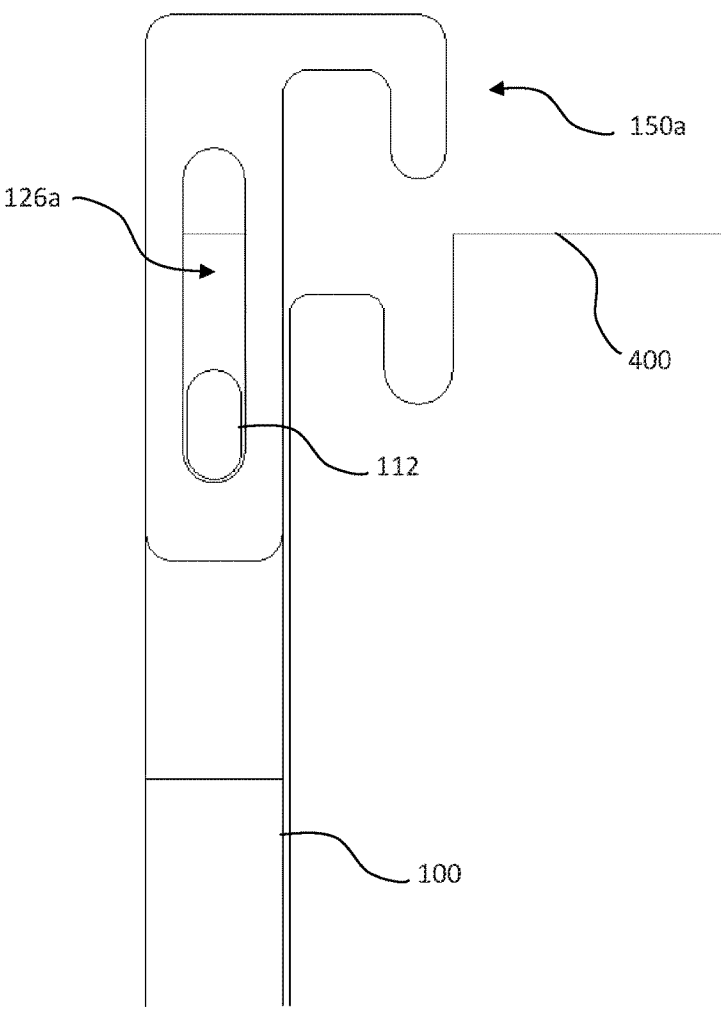
FIG. 15C depicts the shield mount embodiment of FIG. 15A when extended.
Figure 15B:
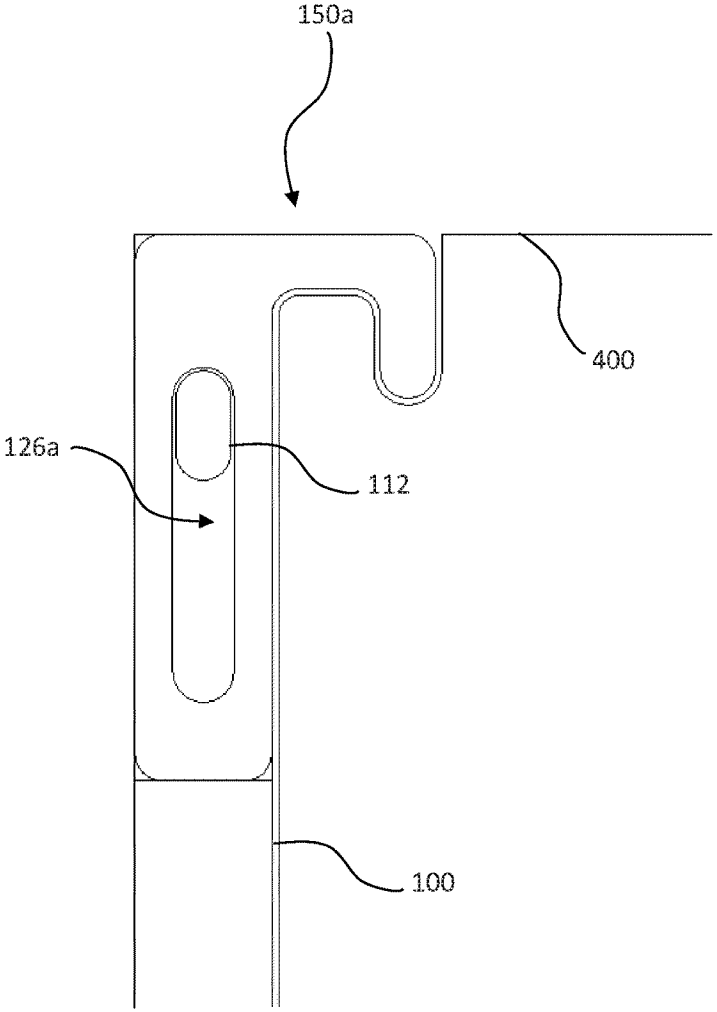
FIG. 15B depicts the shield mount embodiment of FIG. 15A engaged on a shield and container.
Figure 15D:
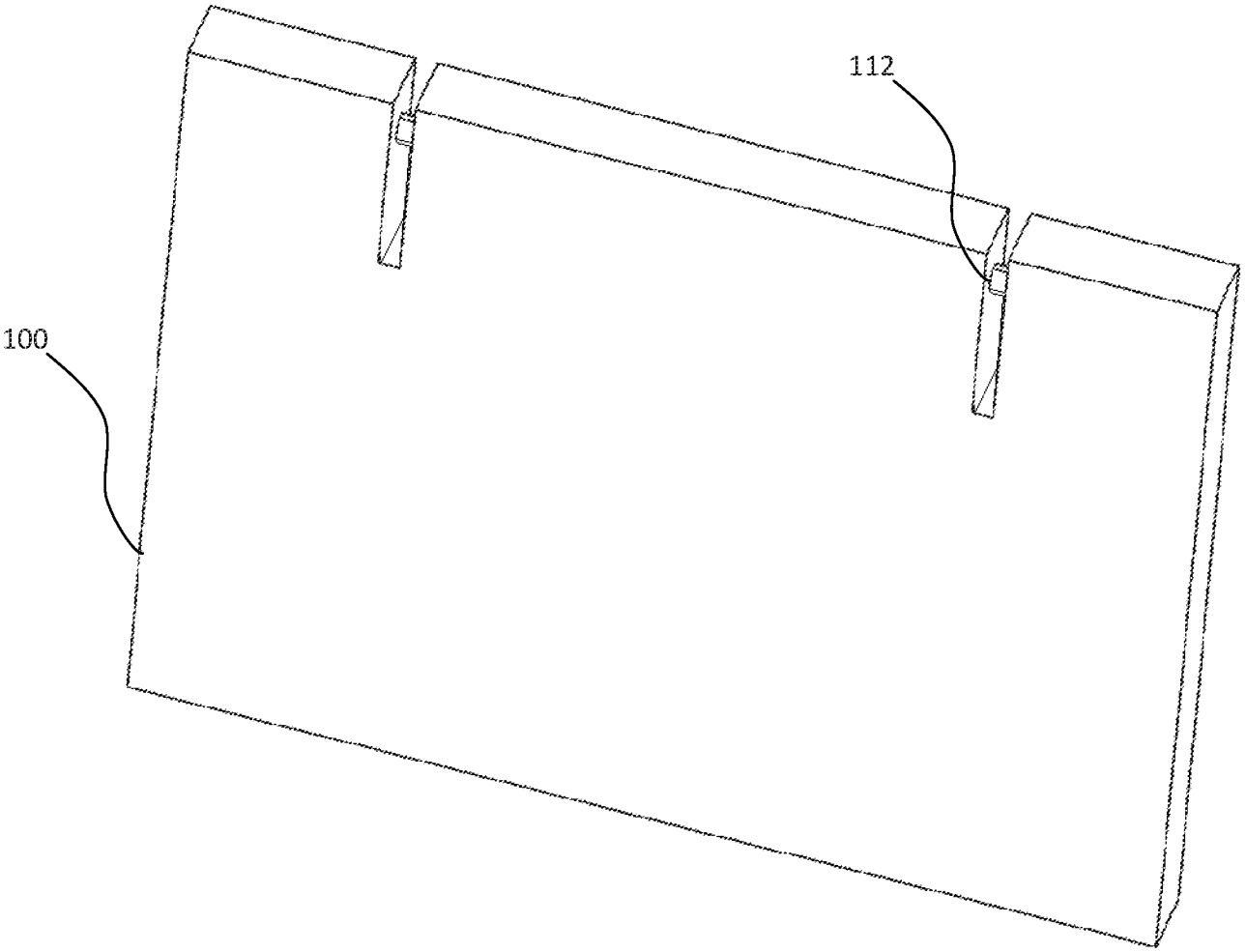
FIG. 15D depicts a shield panel embodiment showing a guide for use with the shield mount embodiment of FIG. 15A.
Figure 15E:
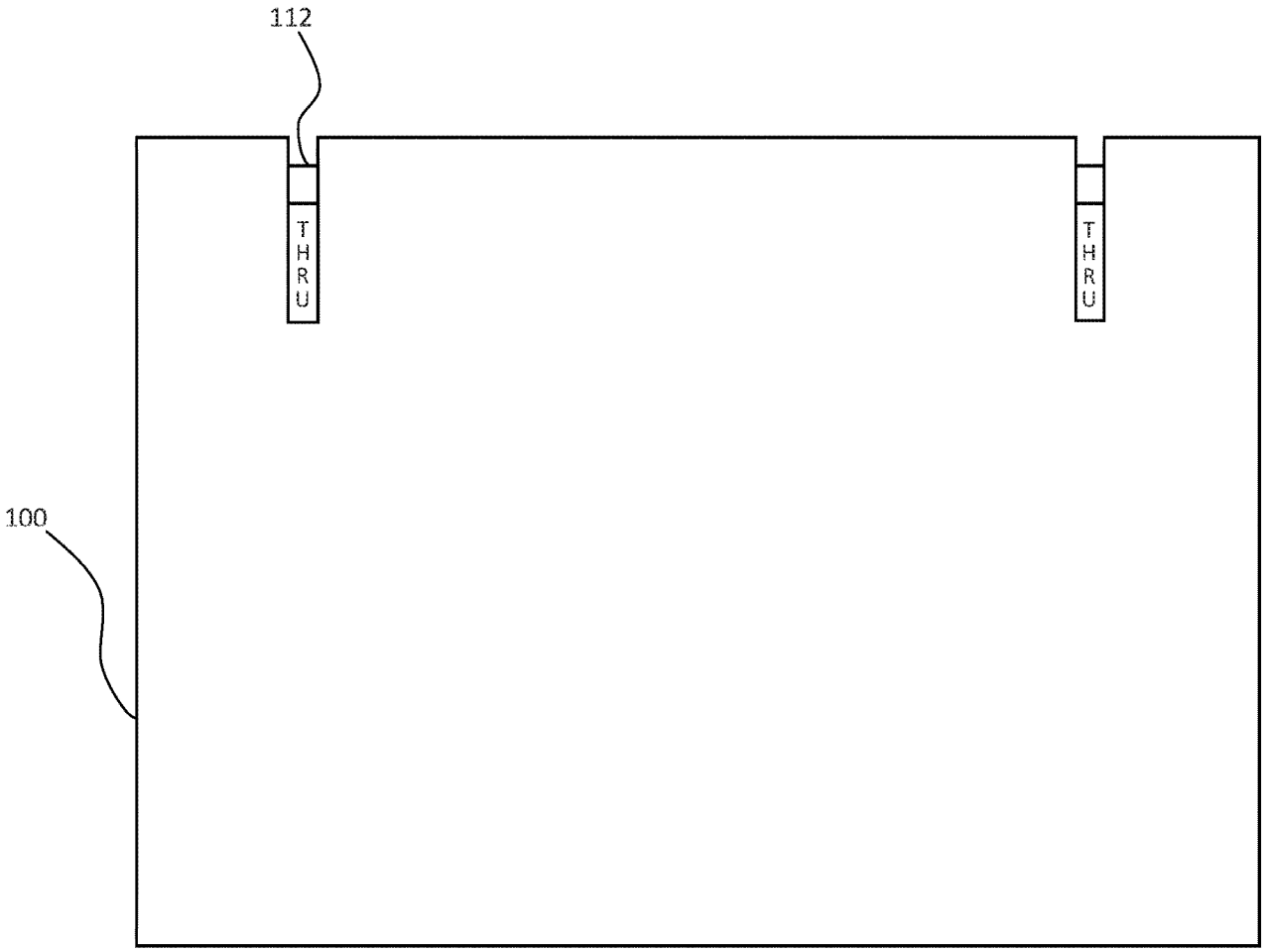
FIG. 15E is a front view of a shield panel embodiment showing a guide for use with the shield mount embodiment of FIG. 15A.

FIGS. 15A through 15C depict a variation of the shield mount embodiment of FIG. 14. The shield mount 150*a* has many of the same features as the shield mount 150 depicted in FIG. 14. Shield mount 150*a* has a closed slot 126*a* where shield mount 150 (FIG. 14) has an open slot 126 (FIG. 14). FIG. 15B and FIG. 15C depict the shield mount 150*a* in use. Closed slot 126*a* fits over guide 112 in the shield panel 100. In the depicted embodiment, the shield mount 150*a* is slidably attached to the shield panel 100 where slot 126*a* slides along guide 112. FIGS. 15D and 15E depict an embodiment of a shield panel 100 corresponding to the shield mount embodiment of FIGS. 15A through 15C. In some embodiments, the shield mount 150*a* may be fixed to the shield panel 100. The guide 112 keeps the shield mount 150*a* aligned and prevents the shield mount 150*a* from being separated from the shield panel 100. In FIG. 15B the shield mount 150*a* is fully engaged with the shield panel 100 and the container 400. In FIG. 15C the shield mount 150*a* is extended from the shield panel 100 and the container 400.

The shield panel system allows for simple adjustment of shield thickness as necessary. For instance, in nuclear waste storage embodiments, shield thickness may require adjustment to maintain dose at acceptable limits (such as 1 mSv/hr on contact). In some embodiments, containers may be stored such that the higher activity containers are stored innermost and lower activity containers are stored outermost to increase shielding of the higher activity containers. If additional shielding is required the panels can be stacked to increase the shield thickness.

Figure 16A:
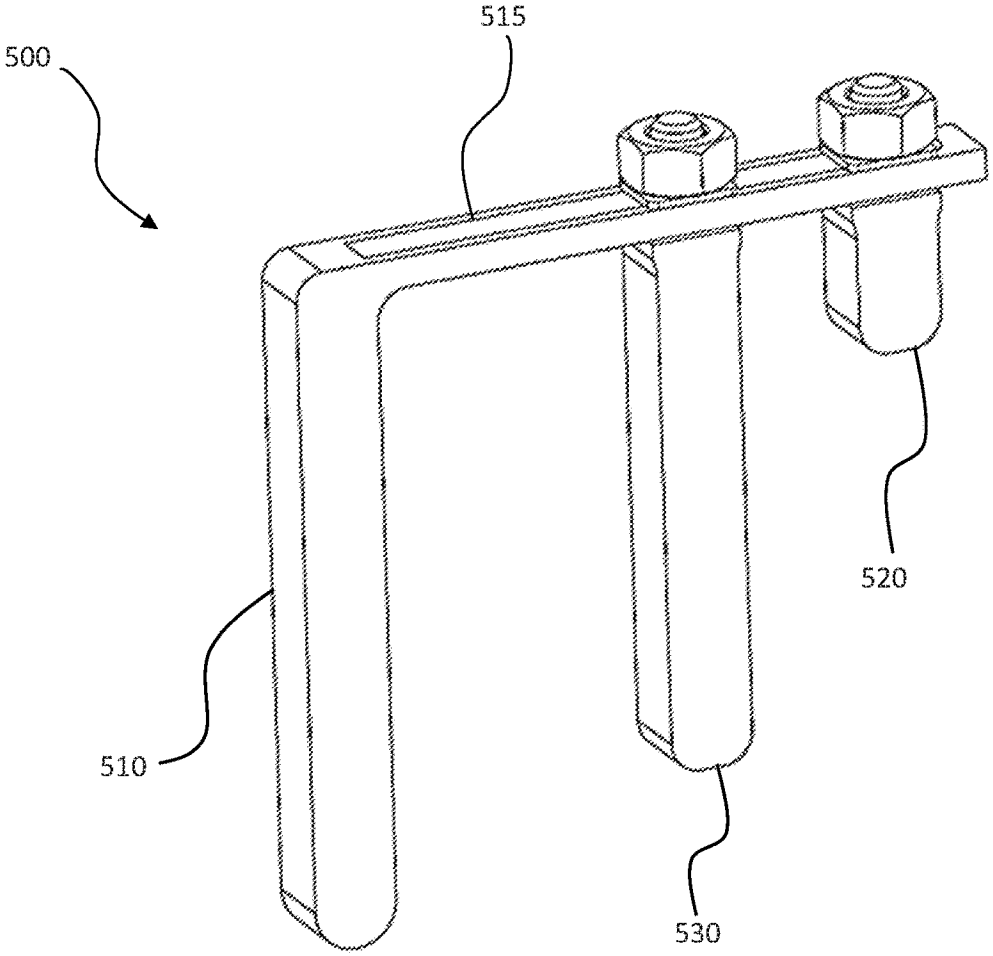
FIG. 16A depicts an embodiment of an adjustable shield mount that can be adjusted for different shield thicknesses.
Figure 16B:
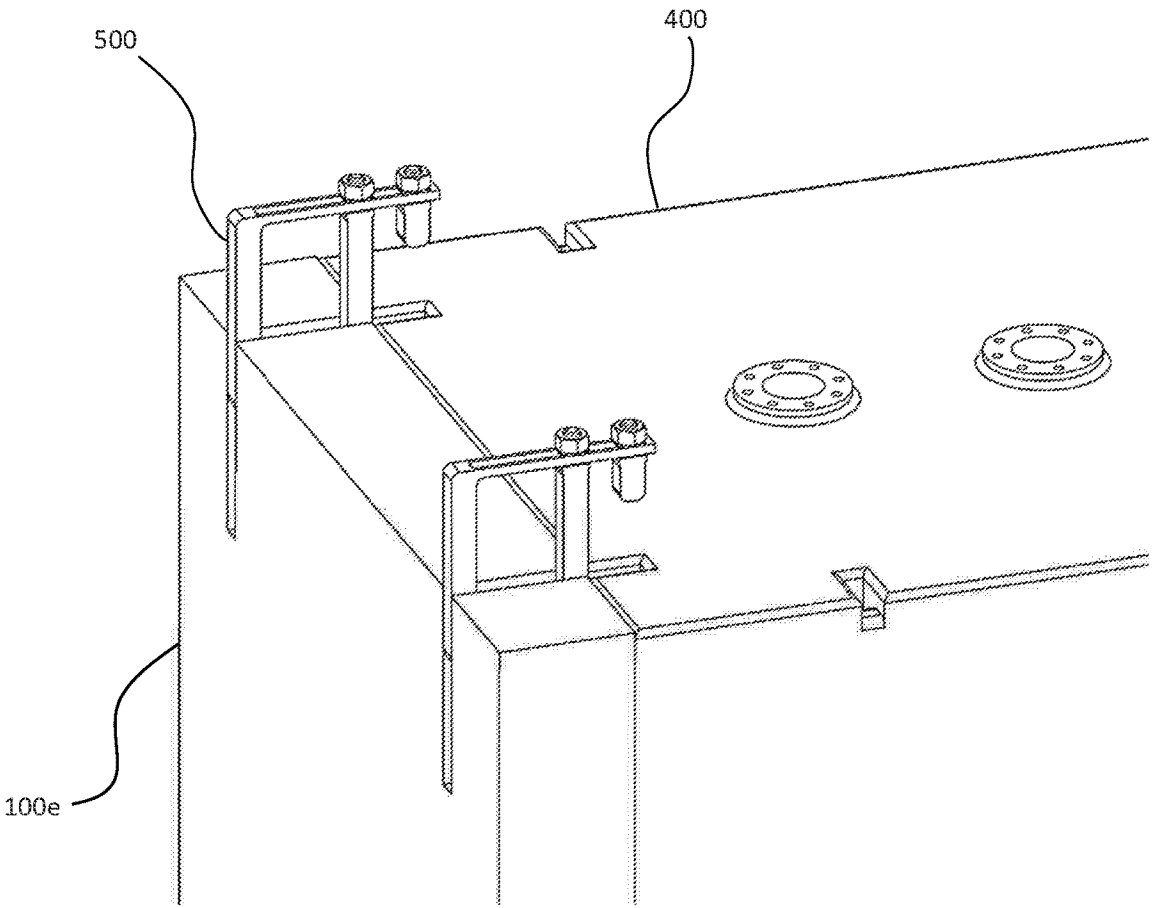
FIG. 16B depicts the adjustable shield mount embodiment of FIG. 16A in use.

FIG. 16A depicts an embodiment of an adjustable shield mount 500 that can be adjusted for different shield thicknesses. The positions of the shield mounting peg 530 and container mounting peg 520 can be adjusted by sliding them along the length of the cut channel 515 to compensate for varying shield thicknesses. In some embodiments, the shield mounting peg 530 and the container mounting peg 520 may be a single component. In the depicted embodiment nuts are used to tighten and secure the mounting pegs in position; however, other fastening mechanisms may be used. FIG. 16B depicts the adjustable shield mount 500 in use with a thick shield 100*e*. In some embodiments, the adjustable shield mount 500 may further comprise a toggle clamp or other such clamping or securing mechanism.

Figure 17A:
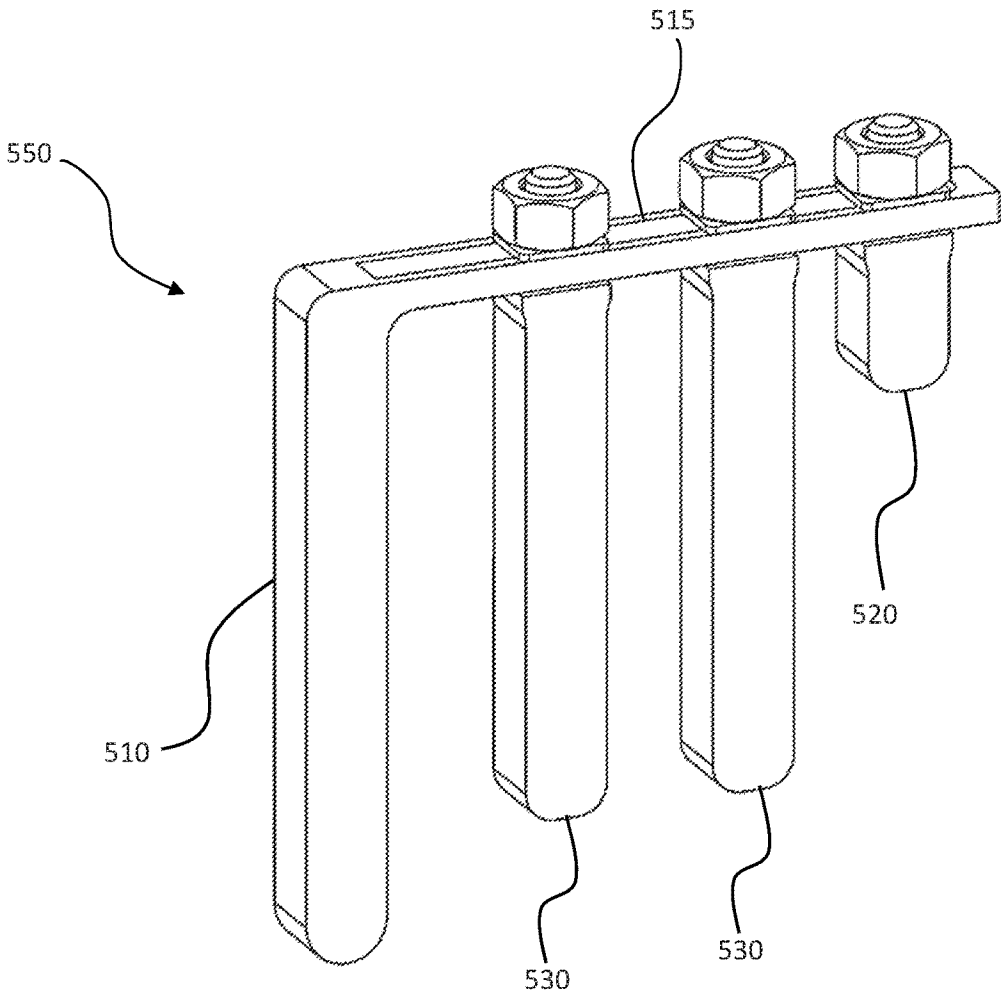
FIG. 17A depicts an alternate embodiment of the adjustable shield mount that can accommodate two shields of different thicknesses.
Figure 17B:
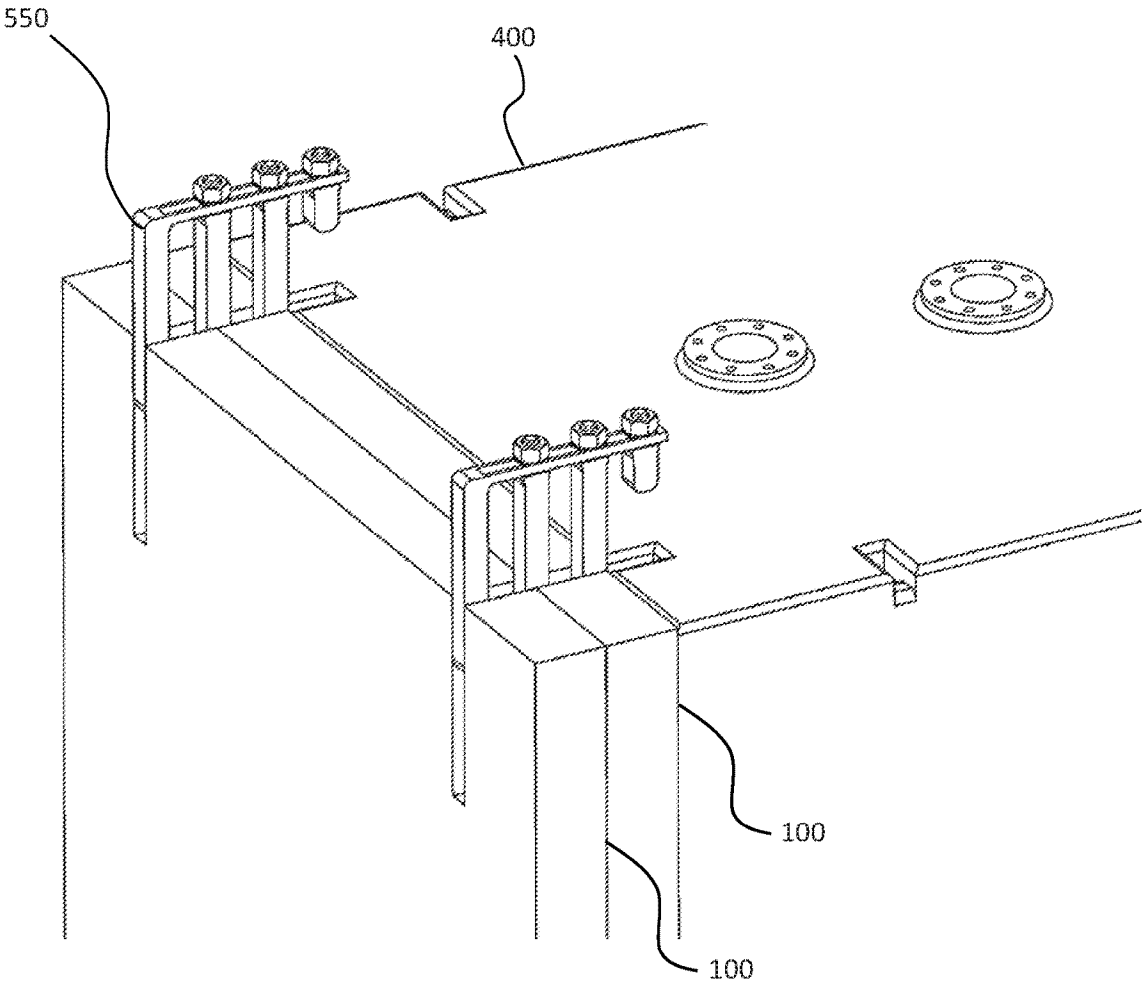
FIG. 17B depicts the adjustable shield mount embodiment of FIG. 17A in use.

FIG. 17A depicts an embodiment of an adjustable shield mount 550 that can accommodate two shields of different thicknesses. The positions of both shield mounting pegs 530 and the container mounting peg 520 can be adjusted by sliding them along the length of the cut channel 515 to compensate for varying shield thicknesses. In some embodiments, the container mounting peg and the nearest shield mounting peg 530 may be a single component. FIG. 17B depicts the adjustable shield mount 550 in use with two shield panels 100. In the depicted embodiment, the shield panels 100 are the same thickness; however, they may be different thicknesses in other embodiments. In the depicted embodiment, nuts are used to tighten and secure the mounting pegs in position; however, other fastening mechanisms may be used. In some embodiments, the adjustable shield mount 550 may further comprise a toggle clamp or other such clamping or securing mechanism.

Figure 18:
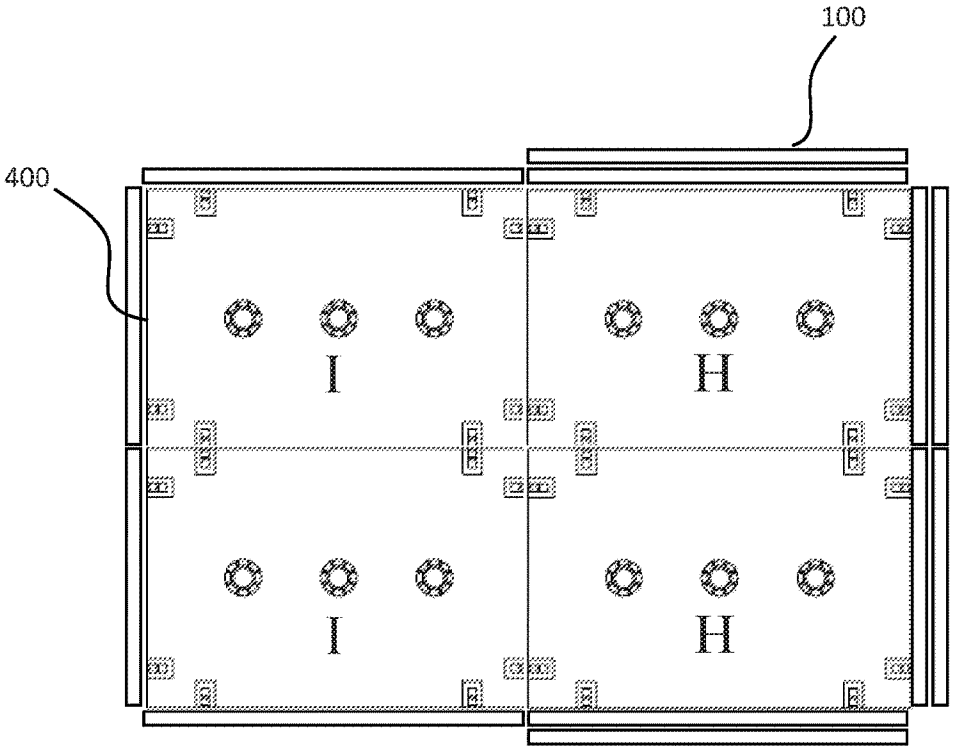
FIG. 18 depicts an embodiment wherein different levels of waste are stored together and require different shielding.

FIG. 18 depicts an example embodiment of a layer of ICV™ containers 400 containing vitrified nuclear waste. In the depicted embodiment, the containers 400 are filled with different classes of nuclear waste. Those marked H contain high level waste and those marked I contain intermediate level waste. Generally in storage configurations containing different waste levels the lower level waste may be used as shielding for the higher level waste, such as the example embodiment depicted in FIG. 6. When it is not possible to use the lower level waste as additional shielding against the higher level waste different types, thickness, and/or layers of shielding may be needed on the higher level waste than on the lower level waste. In the depicted embodiment, all of the same shields are used; however, the shielding is doubled on the higher-level waste. This is an example of when it is useful to have adjustable shield mounts capable of accommodating different numbers and thicknesses of shield panels 100.

Figure 19B:
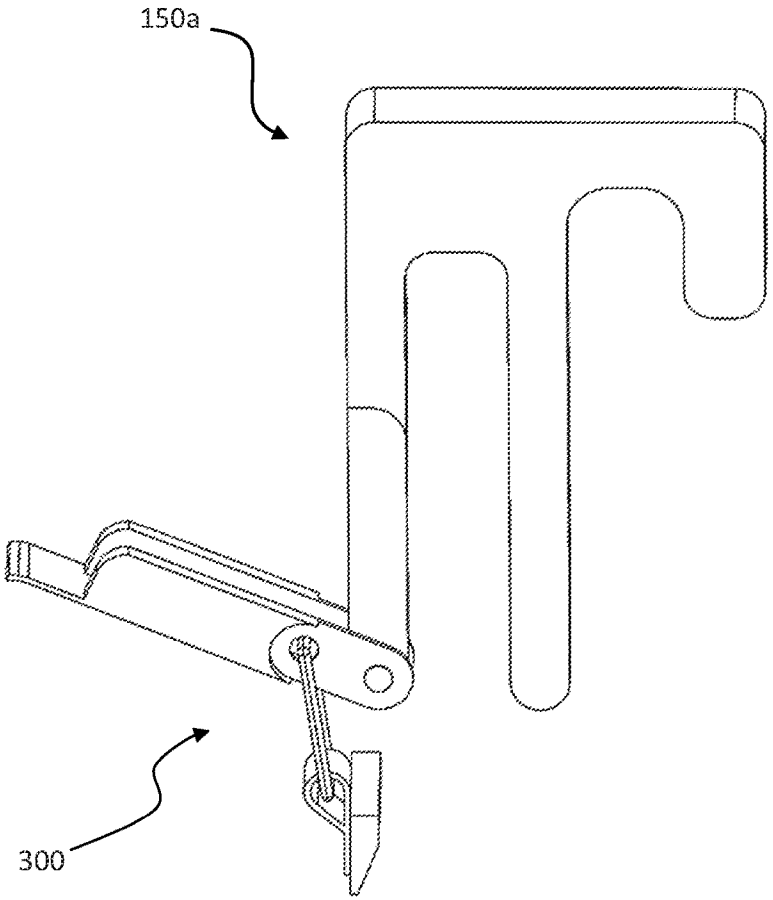
FIG. 19B depicts a side view of the shield mount of FIG. 19A.
Figure 19A:
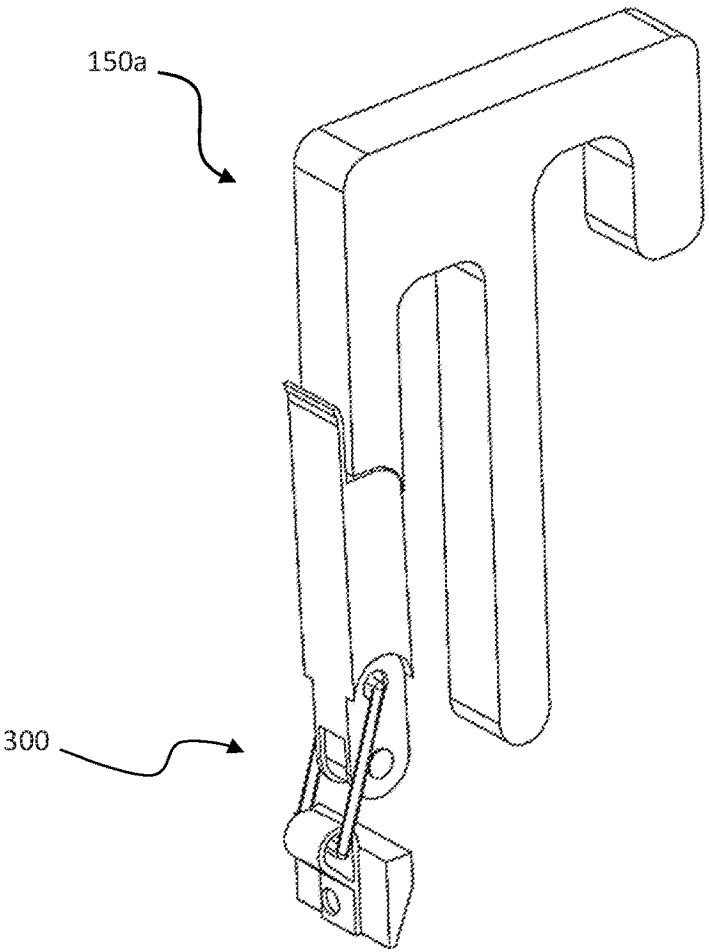
FIG. 19A depicts an isometric view of the shield mount of FIG. 14 that utilizes a toggle clamp mechanism to secure the shield panel.
Figure 19C:
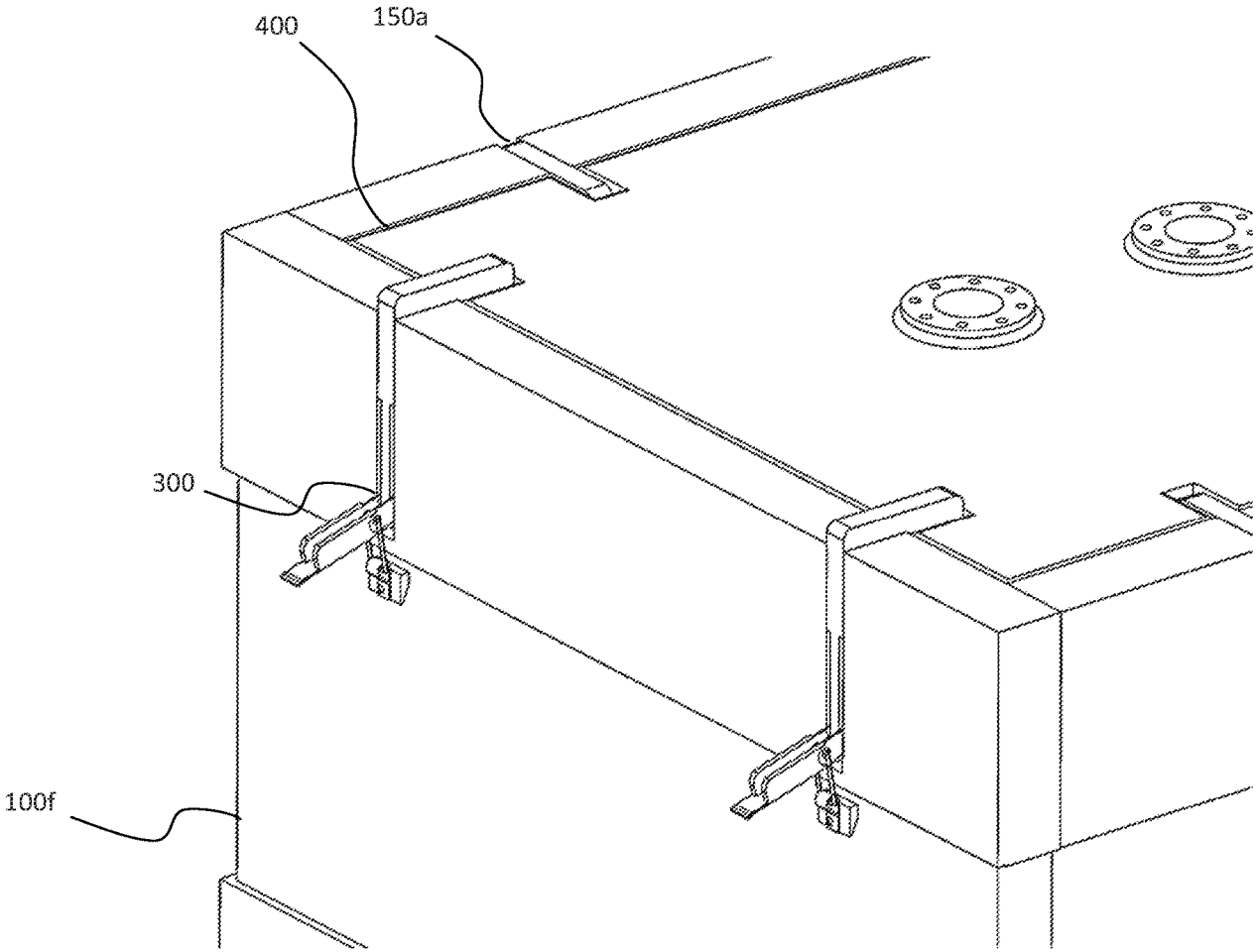
FIG. 19C depicts the shield mount of FIG. 19A in use with modified shield panels.

FIGS. 19A through 19C are described as a group. FIG. 19A depicts an isometric view of an embodiment of a shield mount 150*a* that utilizes a toggle clamp mechanism 300 to secure a modified shield panel 100*f* (FIG. 19C). The toggle clamp 300 fits over the base of the shield mount 150*a* and allows the shield mount 150*a* to be secured to the shield panel 100*f* and the top of the ICV™ container 400 with a clamp mechanism 300 to prevent the shield from slipping downward. FIG. 19B depicts a side view of the shield mount 150*a*. FIG. 19C depicts the shield mount 150*a* in use with modified shield panels 100*f*. In an embodiment, the size and materials used for clamp mechanism 300 may vary based on the size and composition of the shield panel. It should be clear that a 5000-pound shield panel may require sturdier and larger materials for clamp mechanism 300 than a 100-pound shield panel.

Figure 20:
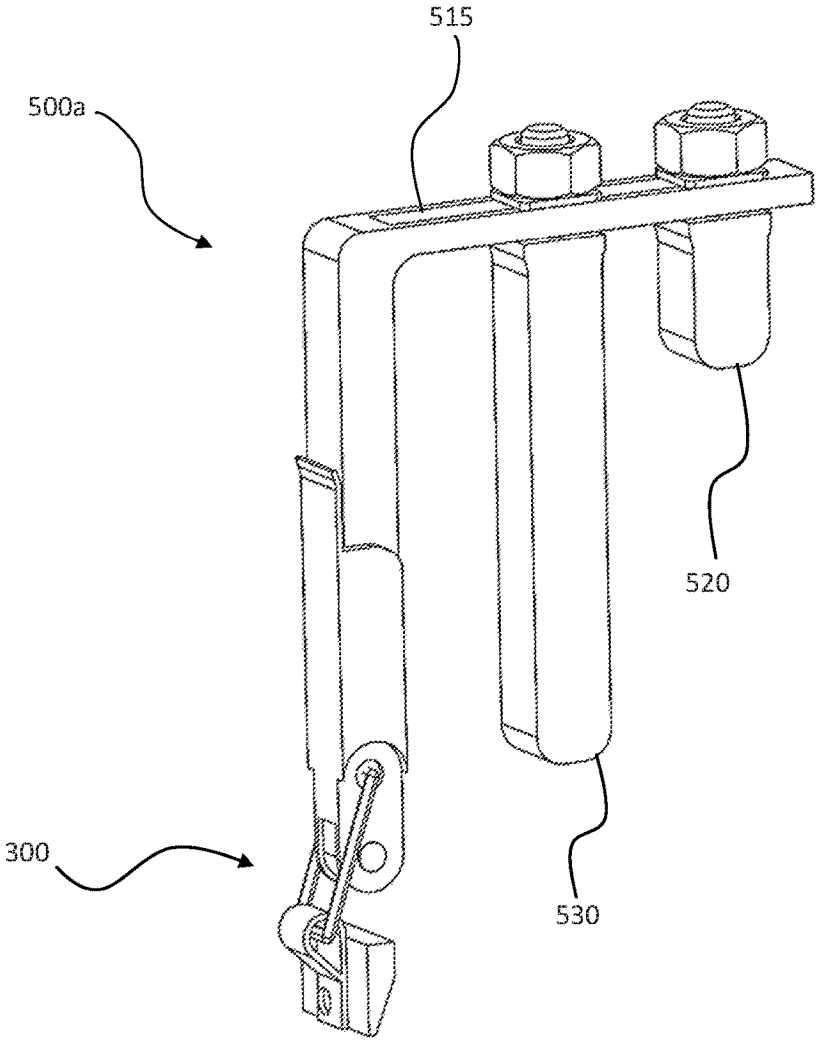
FIG. 20 depicts an embodiment of a shield mount that incorporates the use of a toggle clamp system for securing shields of varying thicknesses.

FIG. 20 depicts an embodiment of an adjustable shield mount 500*a* that incorporates the use of a toggle clamp system 300 for securing shield panels of varying thicknesses. The depicted embodiment incorporates the shield mounting peg 530 and the container mounting peg 520 to accommodate shield panels of varying thicknesses.

Figure 21A:
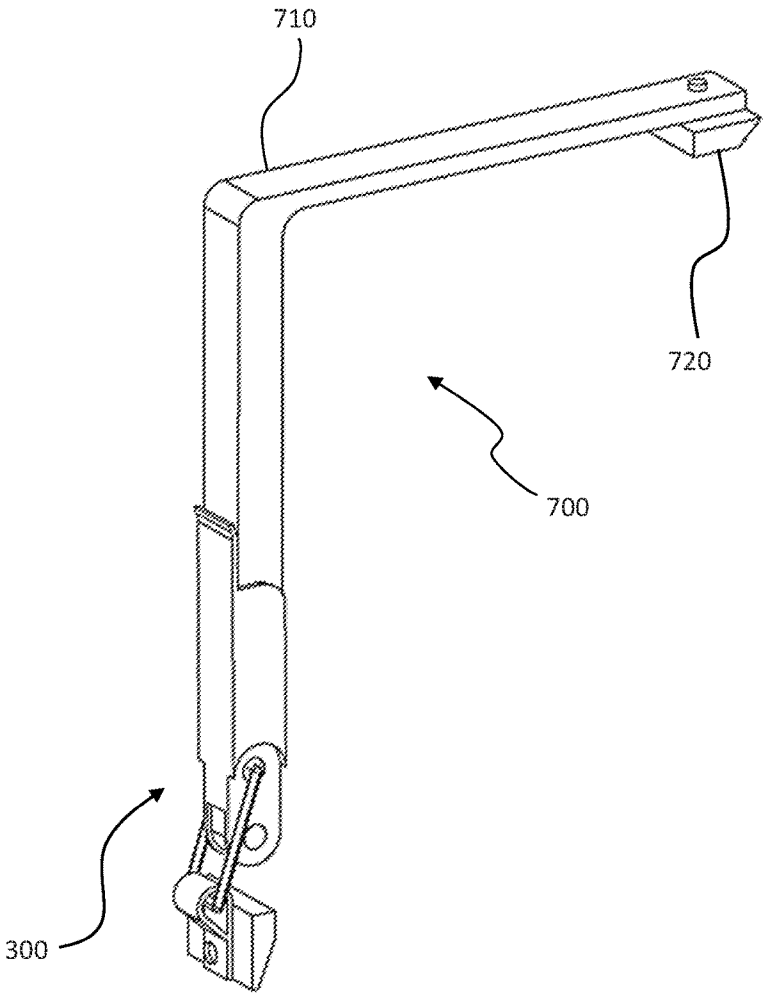
FIG. 21A depicts an embodiment of a shield mount that secures the side shields with a top shield.
Figure 21B:
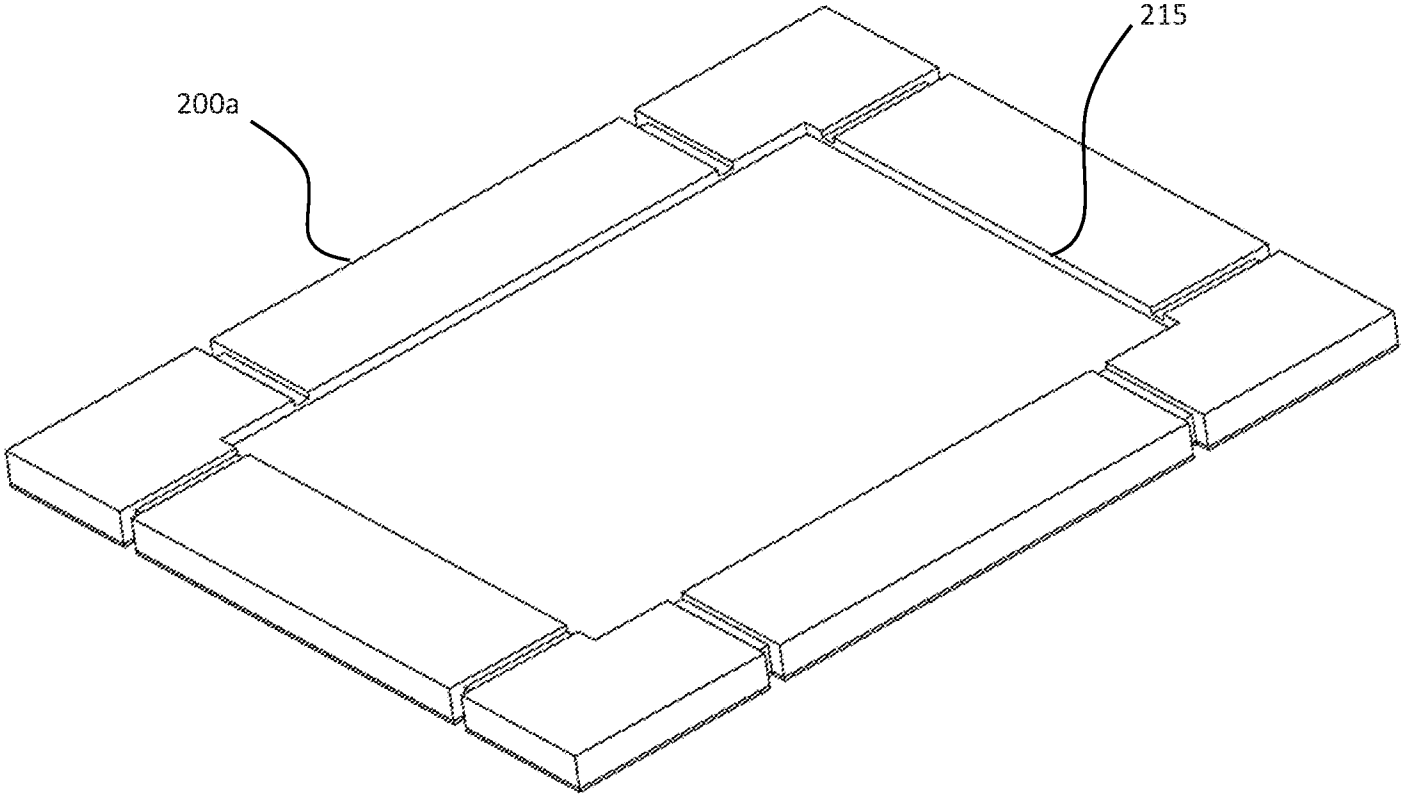
FIG. 21B depicts an embodiment of a top shield that couples with the shield mount embodiment of FIG. 21A.
Figure 21C:
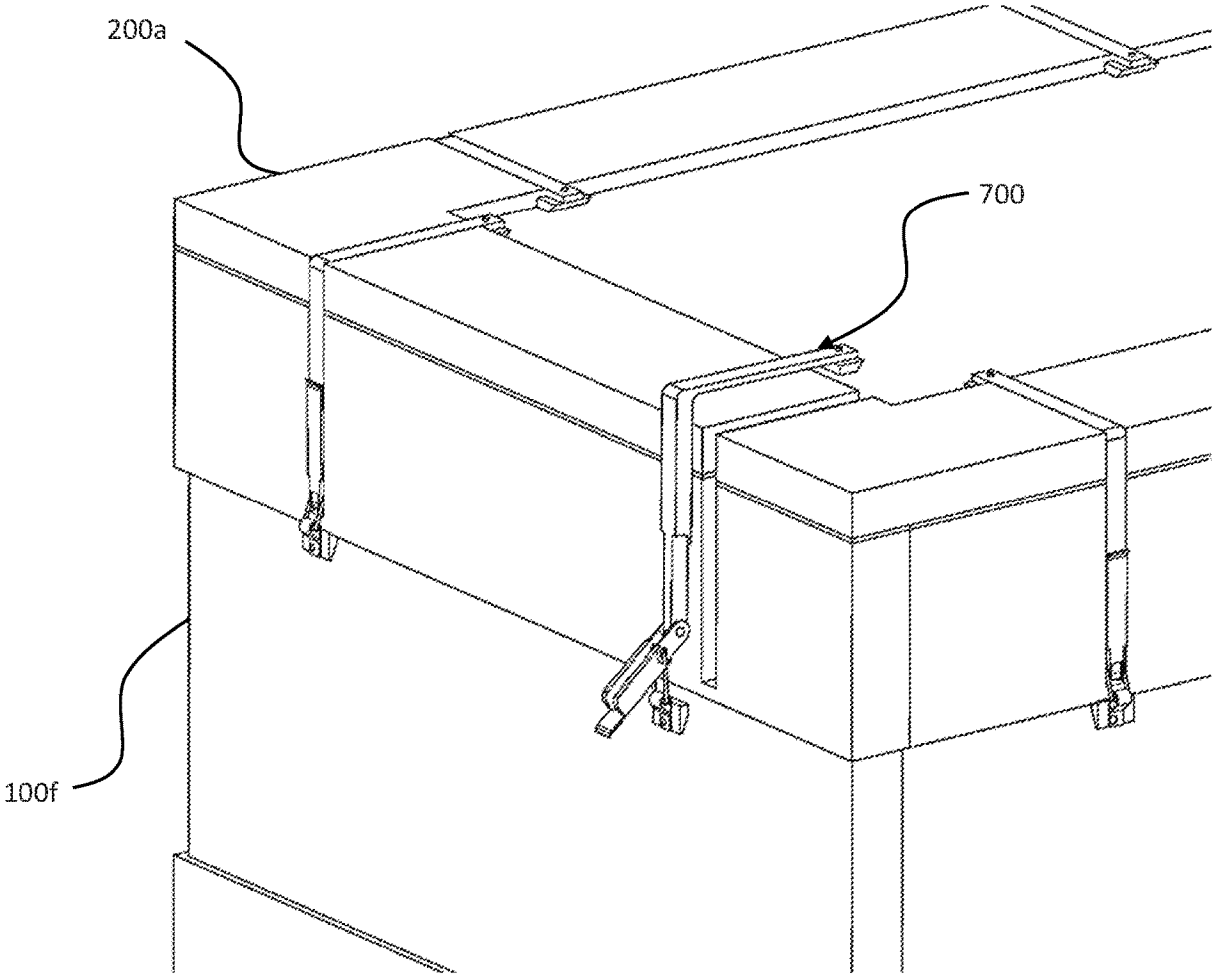
FIG. 21C depicts the top shield embodiment of FIG. 21B in use with the shield mount embodiment of FIG. 21A.

FIG. 21A depicts an embodiment of a shield mount 700 that secures the side shields 100*f* (FIG. 21C) with a top shield 200*a* (FIG. 21B). The shield mount 700 comprises an edge gripper 720 which may be used to secure the top shield 200*a* (FIG. 21B) in place via clamping force and friction. In the depicted embodiment, the edge gripper 720 is fastened to the end of the shield mount 700. In some embodiments, the edge gripper 720 may be integrated to the shield mount 700. In some embodiments, the shield mount may be integrated to the top shield 200. FIG. 21B depicts an embodiment of a top shield 200*a* that couples with the shield mount embodiment 700. FIG. 21C depicts the top shield embodiment 200*a* in use with the shield mount 700 and shield panel 100*f*. In some embodiments, the top shield 200*a* is sized to fit just over the container lid.

Example Embodiment

In an example embodiment, there are one or more storage containers. When there is more than one container the containers may be placed in close proximity to one another to reduce overall storage footprint. This generally means that one or more faces of the storage containers may be in contact with, or very close to, one or more faces of other storage containers in a storage configuration. In some embodiments, shielding is not required on the internal faces in the storage configuration. The exposed faces (external or outermost) of the storage containers in the storage configurations may require shielding. One or more modular shield panels may be applied to the exposed faces to provide shielding to the storage configuration.

Figure 22A:
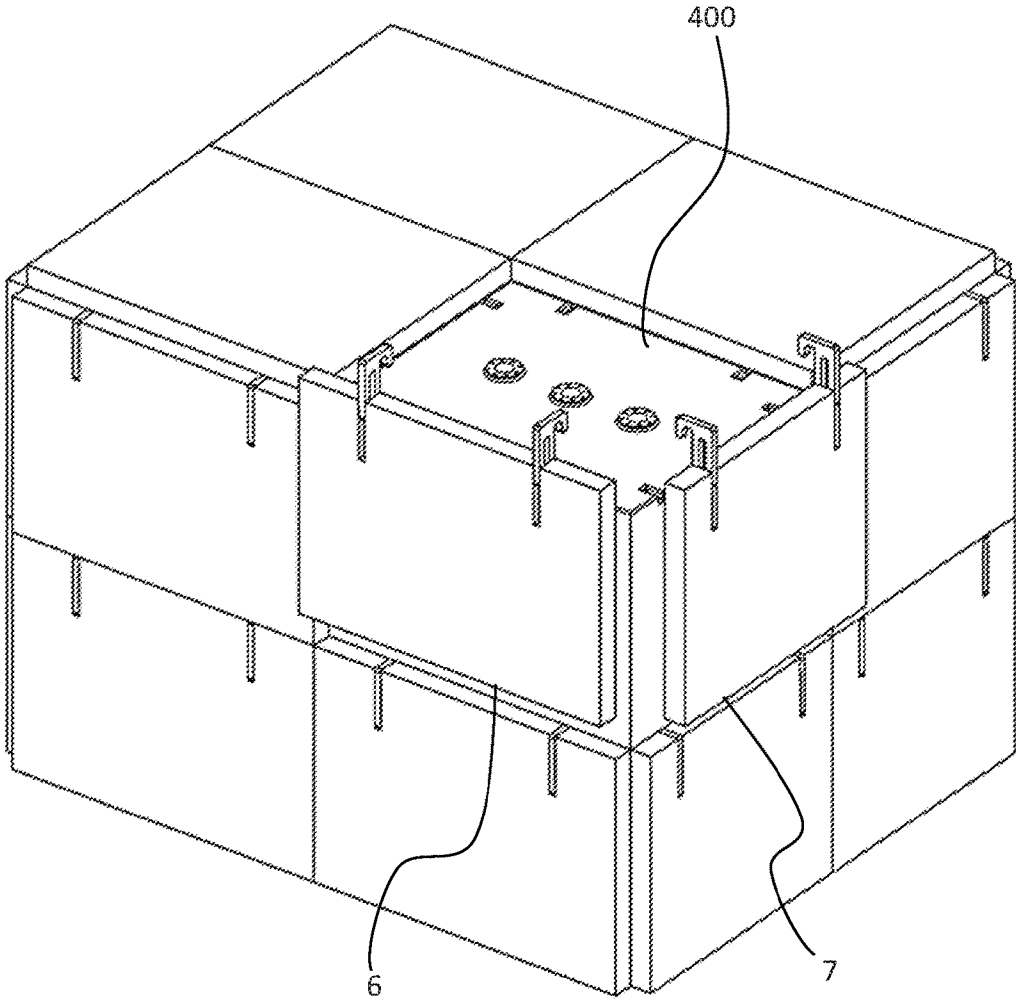
FIG. 22A depicts a storage configuration comprising eight storage containers in process of reconfiguration.
Figure 22B:
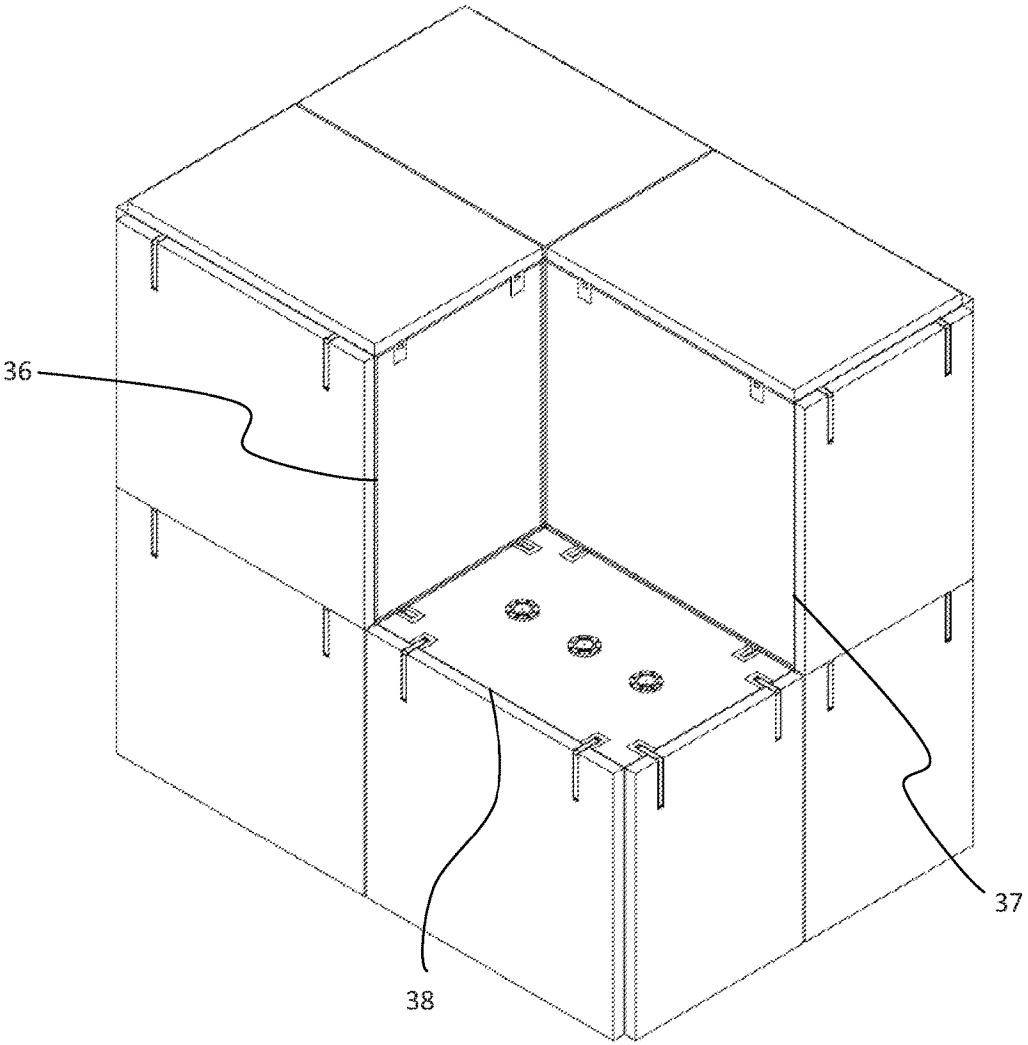
FIG. 22B depicts the storage configuration of FIG. 22A after removal of one of the storage containers.
Figure 22C:
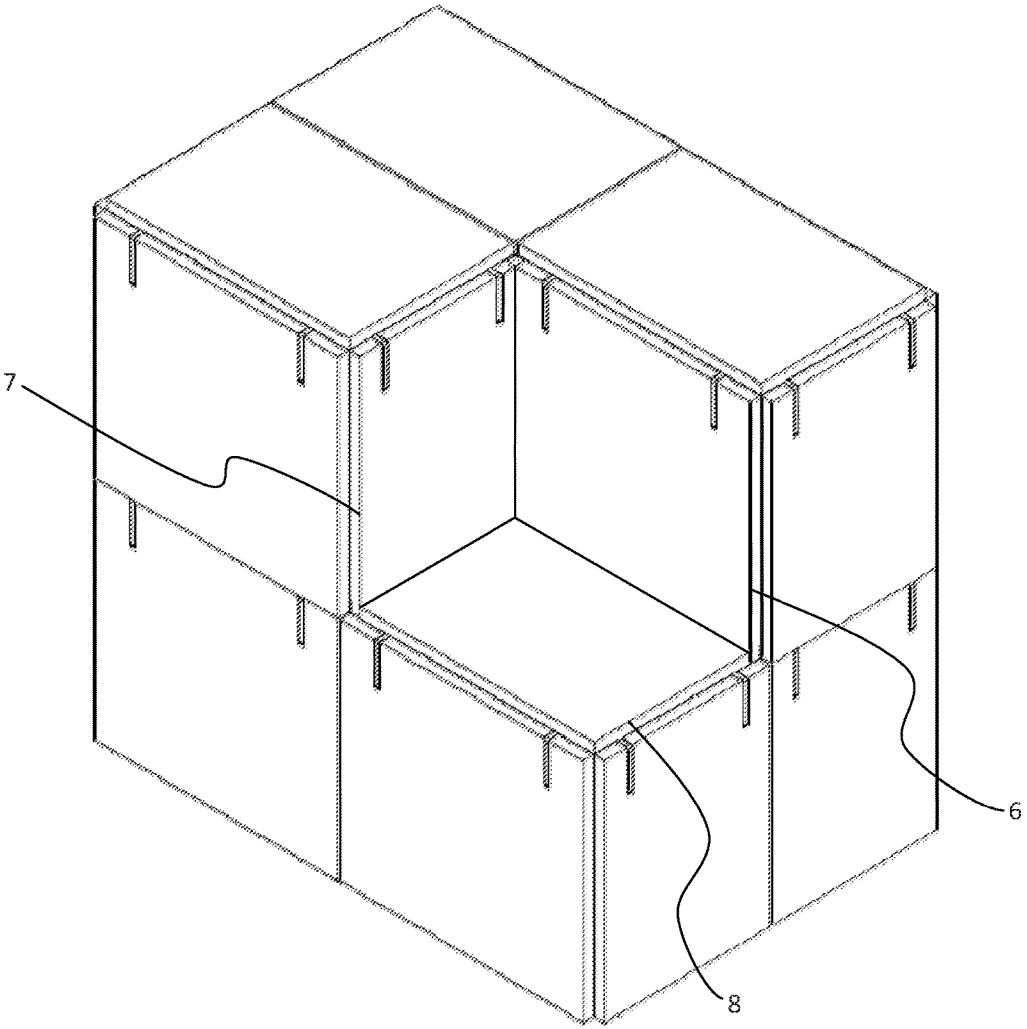
FIG. 22C depicts the storage configuration of FIG. 22B after shield panels have been installed on the exposed faces of the remaining containers in the storage configuration.

FIGS. 22A through 22C depict a storage configuration during and after reconfiguration. FIG. 22A depicts a storage configuration comprising eight storage containers 400. In the depicted embodiment, the visible storage container 400 is about to be removed from the storage configuration. In preparation for removal of the visible storage container 400 top shield panel 8 (FIG. 22C) has been removed and shield panels 6 and 7 are shown in the process of being removed. FIG. 22B depicts the storage configuration of FIG. 22A when the shield panels 6, 7, and 8 (FIG. 22C) and the storage container 400 (FIG. 22A) have been removed exposing faces 36, 37, and 38. FIG. 22C depicts the storage configuration of FIG. 22B after shield panels 6, 7, and 8 have been installed on the exposed faces 36, 37, and 38 of the storage containers.

Example Embodiment

Figures, figure elements, and written disclosure related to the following embodiment are described in detail in the above disclosure. The RSP system allows for modular reconfigurable shielding for one or more storage containers. In an example embodiment, there are a plurality of unshielded storage containers containing nuclear waste. In industry, any container for storing nuclear waste normally comprises, as part of its structure (i.e. not removable), the required shielding for the particular waste level contained therein to keep the radiation dosage below predetermined safety limits. In this example embodiment the nuclear waste storage containers are unshielded i.e. they can be used to store any level of nuclear waste because the shielding required for a particular waste level is not included as part of their structure. These unshielded nuclear waste storage containers are modular and reconfigurable because they can contain any waste level and appropriate shielding can be added as needed based on predetermined dosage requirements for a given storage facility.

In the example embodiment, each unshielded nuclear waste storage container comprises at least one mounting point for mounting one or more modular shield panels to it. Each modular shield panel comprises at least one mounting point for mounting to an unshielded nuclear waste storage container. Depending on the number of shield panels required and the number of shield mounts on the shield panels and the containers, one or more shield mounts may be used to couple with the mounting points on the shield panels and the containers to attach the shield panels to the containers. In some embodiments, one or more of the shield mounts may be adjustable to accommodate shield panels of varying thicknesses.

In the example embodiment, a plurality of nuclear waste storage containers may be stored together. When stored together the sides adjacent to (face-to-face with) other storage containers do not require shielding while, depending on the waste levels contained therein, and the predetermined dosage requirements for the particular storage facility, the outermost (external) faces of the storage containers may require shielding. The sides of the containers that are placed adjacent to other containers do not require additional shielding because the shielding on that side is provided by the neighboring container.

Continuing with the example embodiment, when the storage containers are placed in a storage configuration and all of the external facing sides of the containers are shielded according to the requirements of the particular waste level and/or storage facility the storage configuration is considered to be fully shielded. When an additional unshielded storage container needs to be added to the storage configuration, depending on the layout of the existing configuration, one or more shield panels may be removed from one or more storage containers in the configuration resulting in one or more partially shielded storage containers. The additional unshielded storage container may then be placed in the configuration adjacent to one or more partially shielded storage containers in the configuration. One or more of the previously removed one or more shield panels may then be installed on the external faces of the newly added storage container. If any faces are still exposed (unshielded) additional shield panels may be installed as needed to result in a fully shielded storage configuration.

It should be clear that any one or more aspects of the disclosed shield panels, shield mounts, and shielding configurations may be combined to form other embodiments not expressly disclosed herein. Additionally, the shield mounts may take other geometries and utilize fasteners different than those depicted.

For the sake of convenience, the operations are described as various interconnected functional blocks or distinct software modules. However, this is not necessary, and there may be cases where these functional blocks or modules are equivalently aggregated into a single logic device, program or operation with unclear boundaries. In any event, the functional blocks and software modules or described features can be implemented by themselves, or in combination with other operations in either hardware or software.

Having described and illustrated the principles of the systems, methods, processes, and/or apparatuses disclosed herein in a preferred embodiment thereof, it should be apparent that the systems, methods, processes, and/or apparatuses may be modified in arrangement and detail without departing from such principles. Claim is made to all modifications and variation coming within the spirit and scope of the following claims.

The embodiments in which an exclusive property or privilege is claimed are defined as follows:

1. A modular reconfigurable shielding system for storage containers, comprising:

one or more modular shield panels; and one or more storage containers, wherein the one or more storage containers form a storage configuration such that all exposed faces of the one or more storage containers in the storage configuration are operatively coupled with one of the modular shield panels, and wherein the storage configuration is operatively reconfigurable for at least one of addition and removal of one or more storage containers, wherein:

removal of at least a first coupled modular shield panel from the storage configuration results in a first exposed face of a first storage container in the storage configuration, responsive to removal of at least the first coupled modular shield panel, at least one of removal of the first storage container from the storage configuration and addition of a second storage container to the storage configuration, wherein addition of the second storage container comprises placement of a second exposed face of the second storage container adjacent to the first exposed face of the first storage container, the first coupled modular shield panel is reinstalled to a third exposed face on at least one of the second storage container and a third storage container, responsive to reinstallation of the first coupled modular shield panel, any remaining exposed faces are identified, and addition of supplemental modular shield panels to the remaining exposed faces in the storage configuration results in a new shielded storage configuration, wherein the one or more storage containers contain nuclear waste of at least one of a first level of radioactivity, a second level of radioactivity that is higher than the first level of radioactivity, and a third level of radioactivity that is higher than the first and second levels of radioactivity, and the one or more storage containers comprising nuclear waste of the third level of radioactivity are centrally placed in the storage configuration, and the one or more storage containers comprising nuclear waste of the first level of radioactivity are outermost in the storage configuration.

2. The system of claim 1, wherein the storage configuration is reconfigured remotely from the shielding system.

3. The system of claim 1, wherein the one or more modular shield panels include at least one of hooks, handles, and magnetic connectors to facilitate reconfiguration.

4. The system of claim 3, wherein the at least one of hooks, handles, and magnetic connectors are at least one of recessed into, flush with, and protruding from the surfaces of the one or more modular shield panels.

5. The system of claim 1, wherein each of the one or more modular shield panels comprises at least one or more shield mounting points.

6. The system of claim 5, wherein the one or more shield mounting points are at least one of structurally, fixedly, and slidably attached to the one or more modular shield panels.

7. The system of claim 1, wherein the one or more modular shield panels comprise one or more layers.

8. The system of claim 7, wherein the one or more layers comprise at least one of concrete, steel, and mullite refractory material.

9. The system of claim 1, wherein the one or more modular shield panels are composed of steel and comprise a half-value layer.

10. The system of claim 1, wherein the one or more modular shield panels couple to the one or more storage containers using at least one of interlocking tabs, magnetic forces, suction, hook and loop fasteners, and one or more shield mounts.

11. The system of claim 10, wherein the one or more shield mounts are adjustable to accommodate shield panels of varying thicknesses.

12. The system of claim 10, wherein the one or more shield mounts comprise clamping mechanisms.

13. The system of claim 11, wherein the one or more shield mounts are adjustable to accommodate two of the modular shield panels wherein the two modular shield panels are at least one of same and different thicknesses.

14. The system of claim 1, further comprising one or more corner shields configured to attach into corners formed by adjacent modular shield panels.

15. The system of claim 1, wherein the one or more modular shield panels include temperature control circuitry.

* * * * *